US007232948B2

(12) United States Patent
Zhang

(10) Patent No.: US 7,232,948 B2
(45) Date of Patent: Jun. 19, 2007

(54) SYSTEM AND METHOD FOR AUTOMATIC CLASSIFICATION OF MUSIC

(75) Inventor: Tong Zhang, San Jose, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 227 days.

(21) Appl. No.: 10/625,534

(22) Filed: Jul. 24, 2003

(65) Prior Publication Data

US 2005/0016360 A1 Jan. 27, 2005

(51) Int. Cl.
*G10H 1/00* (2006.01)

(52) U.S. Cl. ..... 84/600; 704/246

(58) Field of Classification Search ..... 84/600, 84/609, 615, 616, 623; 704/243, 245, 246, 704/251, 255, 231; 707/104.1
See application file for complete search history.

(56) References Cited

U.S. PATENT DOCUMENTS 4,015,087 A * 3/1977 Stewart ..... 704/205
5,148,484 A * 9/1992 Kane et al. ..... 704/214
6,185,527 B1 * 2/2001 Petkovic et al. ..... 704/231
6,434,520 B1 * 8/2002 Kanevsky et al. ..... 704/243
6,476,308 B1 11/2002 Zhang ..... 84/616
6,525,255 B1 * 2/2003 Funaki ..... 84/616
2002/0147728 A1 * 10/2002 Goodman et al. ..... 707/104.1
2005/0075863 A1 * 4/2005 Jiang et al. ..... 704/205

OTHER PUBLICATIONS

Tong Zhang, et al.,Chapter 3, Audio Feature Analysis and Chapter 4, Generic Audio Data Segmentation and Indexing, in Content-Based Audio Classification and Retrieval for Audiovisual Data Parsing(Kluwer Academic 2001).

* cited by examiner

*Primary Examiner*—Lincoln Donovan
*Assistant Examiner*—Jianchun Qin

(57) ABSTRACT

A method and system for automatic classification of music is disclosed. A music piece is received and analyzed to determine whether the received music piece includes sounds of human singing. Based on the received music piece, the music piece can be classified as singing or instrumental music. Each of the singing music pieces can be further classified as chorus or a vocal solo piece, and the vocal solo pieces can be additionally classified by gender and voice. The instrumental music pieces are analyzed to determine whether the music piece is that of a symphony or that of a solo artist or small group of artists. The classification and storage of music pieces can be user controlled.

42 Claims, 20 Drawing Sheets

604

SYSTEM AND METHOD FOR AUTOMATIC CLASSIFICATION OF MUSIC

BACKGROUND

The number and size of multimedia works, collections, and databases, whether personal or commercial, have grown in recent years with the advent of compact disks, MP3 disks, affordable personal computer and multimedia systems, the Internet, and online media sharing websites. Being able to efficiently browse these files and to discern their content is important to users who desire to make listening, cataloguing, indexing, and/or purchasing decisions from a plethora of possible audiovisual works and from databases or collections of many separate audiovisual works.

A classification system for categorizing the audio portions of multimedia works can facilitate the browsing, selection, cataloging, and/or retrieval of preferred or targeted audiovisual works, including digital audio works, by categorizing the works by the content of their audio portions. One technique for classifying audio data into music and speech categories by audio feature analysis is discussed in Tong Zhang, et al.,Chapter 3, *Audio Feature Analysis* and Chapter 4, *Generic Audio Data Segmentation and Indexing*, in CONTENT-BASED AUDIO CLASSIFICATION AND RETRIEVAL FOR AUDIOVISUAL DATA PARSING (Kluwer Academic 2001), the contents of which are incorporated herein by reference.

SUMMARY

Exemplary embodiments are directed to a method and system for automatic classification of music, including receiving a music piece to be classified; determining when the received music piece comprises human singing; labeling the received music piece as singing music when the received music piece is determined to comprise human singing; and labeling the received music piece as instrumental music when the received music piece is not determined to comprise human singing.

An additional embodiment is directed toward a method for classification of music, including selecting parameters for controlling the classification of a music piece, wherein the selected parameters establish a hierarchy of categories for classifying the music piece; determining, in a hierarchical order and for each selected category, when the music piece satisfies the category; labeling the music piece with each selected category satisfied by the music piece; and when the music piece satisfies at least one selected category, writing the labeled music piece into a library according to a hierarchy of the categories satisfied by the music piece.

Alternative embodiments provide for a computer-based system for automatic classification of music, including a device configured to receive a music piece to be classified; and a computer configured to determine when the received music piece comprises human singing; label the received music piece as singing music when the received music piece is determined to comprise human singing; label the received music piece as instrumental music when the received music piece is not determined to comprise human singing; and write the labeled music piece into a library of classified music pieces.

A further embodiment is directed to a system for automatically classifying a music piece, including means for receiving a music piece to be classified; means for selecting categories to control the classifying of the received music piece; means for classifying the received music piece based on the selected categories; and means for determining when the received music piece comprises human singing and/or instrumental music based on the classification of the received music piece.

Another embodiment provides for a computer readable medium encoded with software for automatically classifying a music piece, wherein the software is provided for: determining when a music piece comprises human singing; labeling the music piece as singing music when the music piece is determined to comprise human singing; and labeling the music piece as instrumental music when the music piece is not determined to comprise human singing.

BRIEF DESCRIPTION OF THE DRAWINGS

The accompanying drawings provide visual representations which will be used to more fully describe the representative embodiments disclosed herein and can be used by those skilled in the art to better understand them and their inherent advantages. In these drawings, like reference numerals identify corresponding elements, and.

DETAILED DESCRIPTION OF THE EMBODIMENTS

Figure 1:
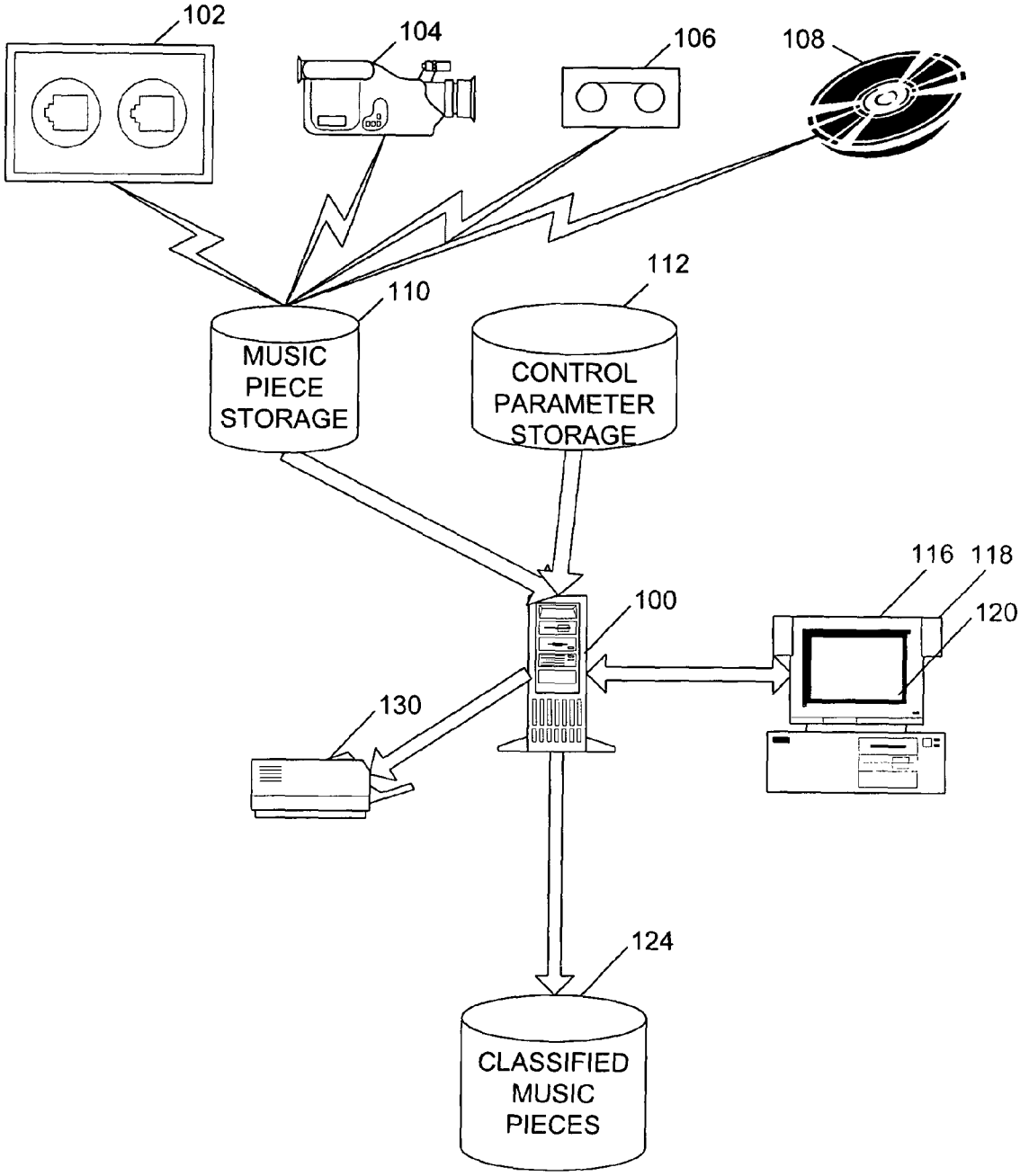
FIG. 1 shows a component diagram of a system for automatic classification of music from an audio signal in accordance with an exemplary embodiment of the invention.

FIG. 1 illustrates a computer-based system for classification of a music piece according to an exemplary embodiment. The term, "music piece," as used herein is intended to broadly refer to any electronic form of music, including both analog and digital representations of sound, that can be processed by analyzing the content of the sound information for classifying the music piece into one or more categories of music. A music piece to be analyzed by exemplary embodiments can include, for purposes of explanation and not limitation, a music segment; a single musical work, such as a song; a partial rendition of a musical work; multiple musical works combined together; or any combination thereof. In an exemplary embodiment, the music pieces can be electronic forms of music, with the music comprised of human sounds, such as singing, and instrumental music. However, the music pieces can include non-human, non-singing, and non-instrumental sounds without detracting from the classification features of exemplary embodiments. Exemplary embodiments recognize that human voice content in musical works can include many forms of human voice, including singing, speaking, ballads, and rap, to name a few. The term, "human singing," as used herein is intended to encompass all forms of human voice content that can be included in a musical piece, including traditional singing in musical tones, chanting, rapping, speaking, ballads, and the like.

FIG. 1 shows a recording device such as a tape recorder 102 configured to record an audio track. Alternatively, any number of recording devices, such as a video camera 104, can be used to capture an electronic track of musical sounds, including singing and instrumental music. The resultant recorded audio track can be stored on such media as cassette tapes 106 and/or CD's 108. For the convenience of processing the audio signals, the audio signals can also be stored in a memory or on a storage device 110 to be subsequently processed by a computer 100 comprising one or more processors.

Exemplary embodiments are compatible with various networks, including the Internet, whereby the audio signals can be downloaded across the network for processing on the computer 100. The resultant output musical classification and/or tagged music pieces can be uploaded across the network for subsequent storage and/or browsing by a user who is situated remotely from the computer 100.

One or more music pieces comprising audio signals are input to a processor in a computer 100 according to exemplary embodiments. Means for receiving the audio signals for processing by the computer 100 can include any of the recording and storage devices discussed above and any input device coupled to the computer 100 for the reception of audio signals. The computer 100 and the devices coupled to the computer 100 as shown in FIG. 1 are means that can be configured to receive and classify music according to exemplary embodiments. In particular, the processor in the computer 100 can be a single processor or can be multiple processors, such as first, second, and third processors, each processor adapted by software or instructions of exemplary embodiments for performing classification of a music piece. The multiple processors can be integrated within the computer 100 or can be configured in separate computers which are not shown in FIG. 1.

These processor(s) and the software guiding them can comprise the means by which the computer 100 can determine whether a received music piece comprises human singing and for labeling the music pieces as a particular category of music. For example, separate means in the form of software modules within the computer 100 can control the processor(s) for determining when the music piece includes human singing and when the music piece does not include human singing. The computer 100 can include a computer-readable medium encoded with software or instructions for controlling and directing processing on the computer 100 for directing automatic classification of music. The music piece can be an audiovisual work; and a processing step can isolate the music portion of an audio or an audiovisual work prior to classification processing without detracting from the features of exemplary embodiments.

The computer 100 can include a display, graphical user interface, personal computer 116 or the like for controlling the processing of the classification, for viewing the classification results on a monitor 120, and/or for listening to all or a portion of a selected or retrieved music piece over the speakers 118. One or more music pieces are input to the computer 100 from a source of sound as captured by one or more recorders 102, cameras 104, or the like and/or from a prior recording of a sound-generating event stored on a medium such as a tape 106 or CD 108. While FIG. 1 shows the music pieces from the recorder 102, the camera 104, the tape 106, and the CD 108 being stored on an audio signal storage medium 110 prior to being input to the computer 100 for processing, the music pieces can also be input to the computer 100 directly from any of these devices without detracting from the features of exemplary embodiments. The media upon which the music pieces is recorded can be any known analog or digital media and can include transmission of the music pieces from the site of the event to the site of the audio signal storage 110 and/or the computer 100.

Embodiments can also be implemented within the recorder 102 or camera 104 themselves so that the music pieces can be classified concurrently with, or shortly after, the musical event being recorded. Further, exemplary embodiments of the music classification system can be implemented in electronic devices other than the computer 100 without detracting from the features of the system. For example, and not limitation, embodiments can be implemented in one or more components of an entertainment system, such as in a CD/VCD/DVD player, a VCR recorder/player, etc. In such configurations, embodiments of the music classification system can generate classifications prior to or concurrent with the playing of the music piece.

Figure 10:
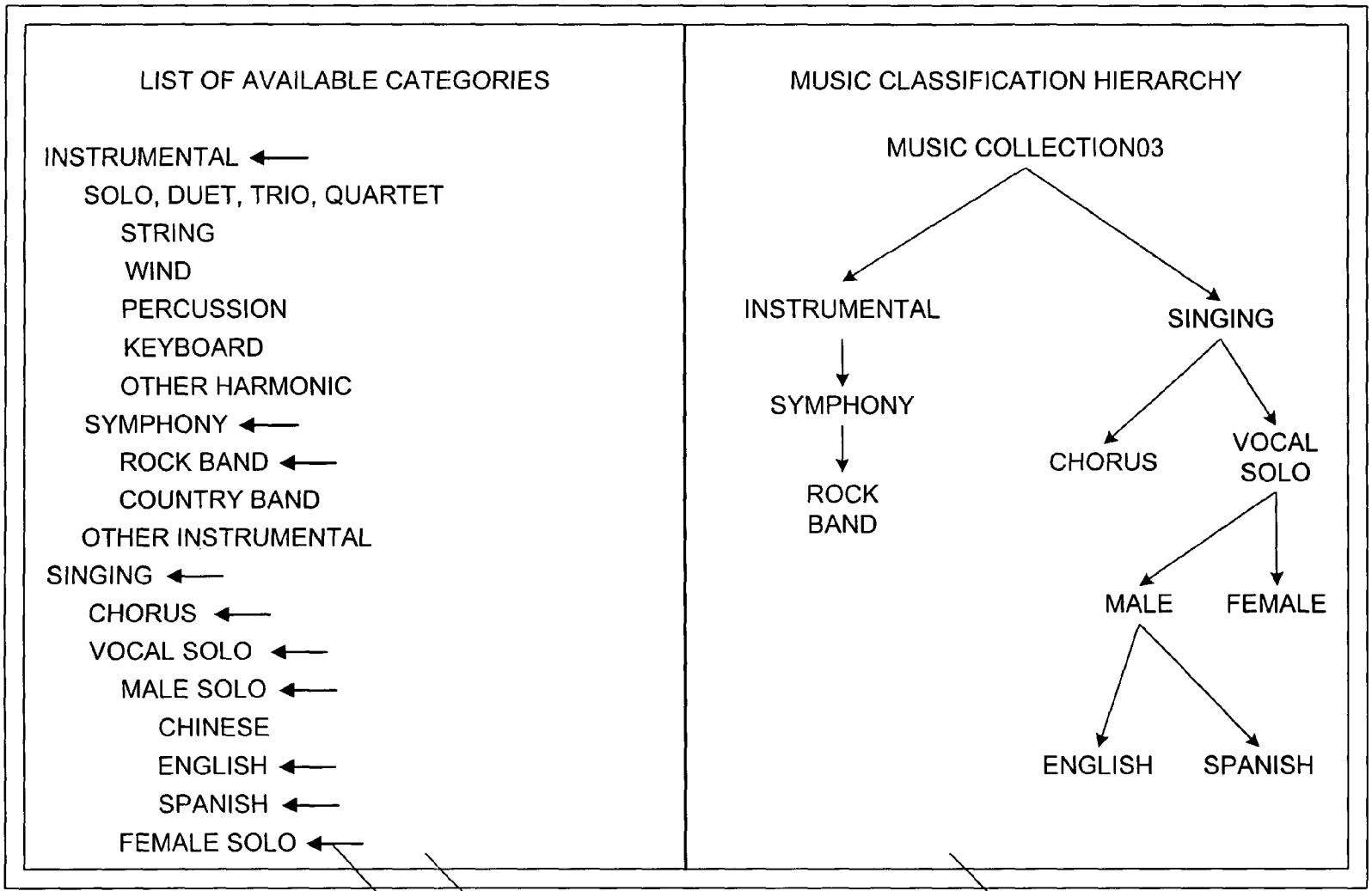
FIG. 10 shows an exemplary user interface for selecting categories by which a music piece is to be classified.

The computer 100 optionally accepts as parameters one or more variables for controlling the processing of exemplary embodiments. As will be explained in more detail below, exemplary embodiments can apply one or more selection and/or elimination parameters to control the classification processing to customize the classification and/or the cataloging processes according to the preferences of a particular user. Parameters for controlling the classification process and for creating custom categories and catalogs of music pieces can be retained on and accessed from storage 112. For example, a user can select, by means of the computer or graphical user interface 116 as shown in FIG. 10, a plurality of music categories by which to control, adjust, and/or customize the classification process, such as, e.g., selecting to classify only pure flute solos. These control parameters can be input through a user interface, such as the computer 116 or can be input from a storage device 112, memory of the computer 100, or from alternative storage media without detracting from the features of exemplary embodiments. Music pieces classified by exemplary embodiments can be written into a storage media 124 in the forms of files, catalogs, libraries, and/or databases in a sequential and/or hierarchical format. In an alternative embodiment, tags denoting the classification of the music piece can be appended to each music piece classified and written to the storage device 124. The processor operating under control of exemplary embodiments can output the results of the music classification process, including summaries and statistics, to a printer 130.

While exemplary embodiments are directed toward systems and methods for classification of music pieces, embodiments can also be applied to automatically output the classified music pieces to one or more storage devices, databases, and/or hierarchical files 124 in accordance with the classification results so that the classified music pieces are stored according to their respective classification(s). In this manner, a user can automatically create a library and/or catalog of music pieces organized by the classes and/or categories of the music pieces. For example, all pure guitar pieces can be stored in a unique file for subsequent browsing, selection, and listening.

Figure 2:
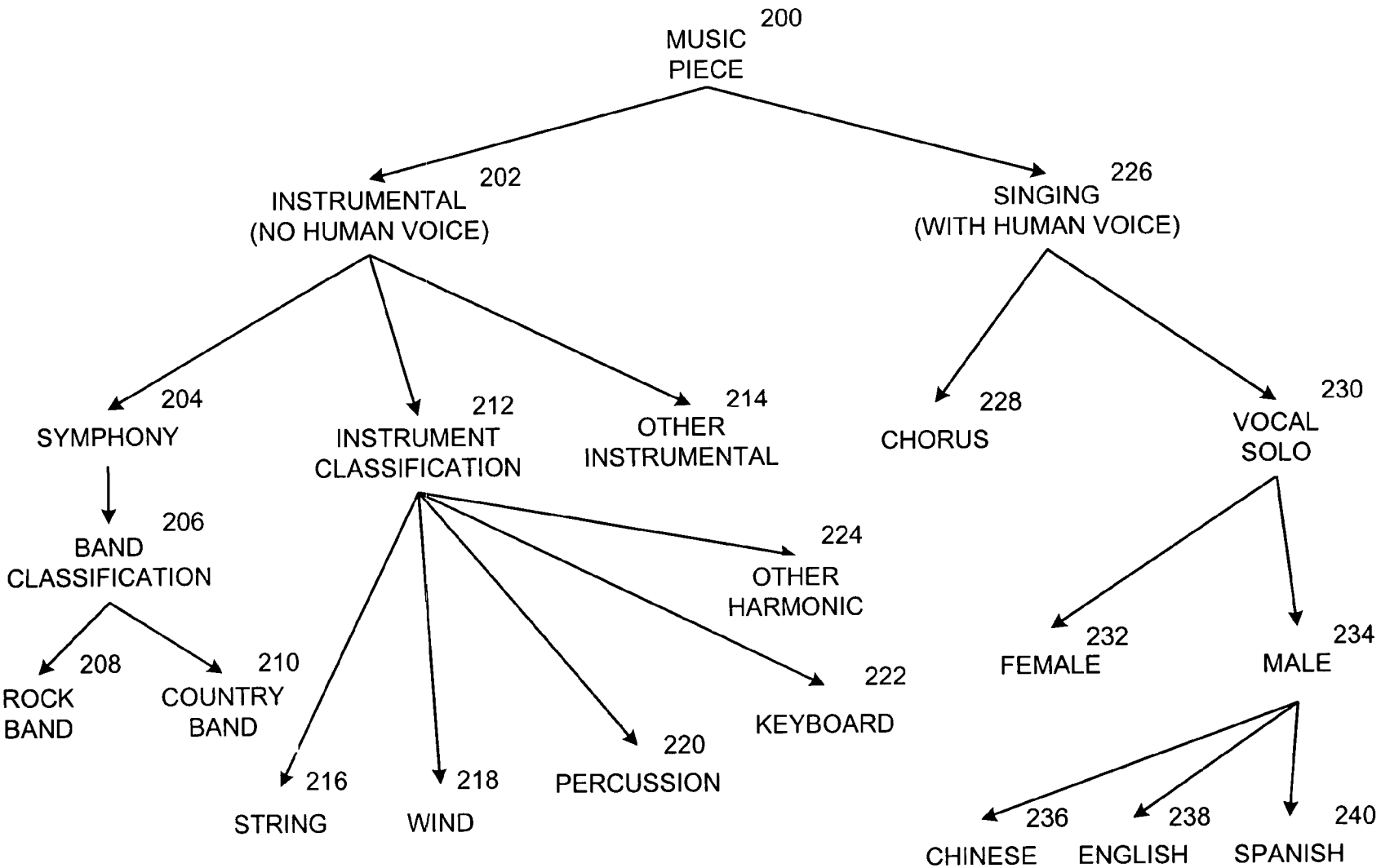
FIG. 2 shows a tree flow chart of the classification of an audio signal into categories of music according to an exemplary embodiment.

The functionality of an embodiment for automatically classifying music can be shown with the following exemplary flow description:

Classification of Music Flow:
Receive a music piece for classification
Determine whether the received music piece includes human singing
Classify the music piece as instrumental or singing
  If instrumental, determine if the music piece is by a symphony
    Determine if the music piece is percussion
    Determine if the music piece is by a specific instrument
  If singing, determine if the music piece is by a chorus or a solo
    If solo, determine if the singer is female or male
Label the classified music piece
Store the classified music piece according to its classification Referring now to FIGS. 1, 2, and 3, a description of an exemplary embodiment of a system for automatic classification of music will be presented. An overview of the music classification process, with an exemplary hierarchy of music classification categories, is shown in FIG. 2. The categories and structure shown in FIG. 2 are intended to be exemplary and not limiting, and any number of classes of music pieces and hierarchical structure of the music pieces can be selected by a user for controlling the classification process and, optionally, a subsequent cataloging and music piece storage step. For example, the wind category 218 can be further qualified as flute, trumpet, clarinet, and french horn.

Figure 3A:
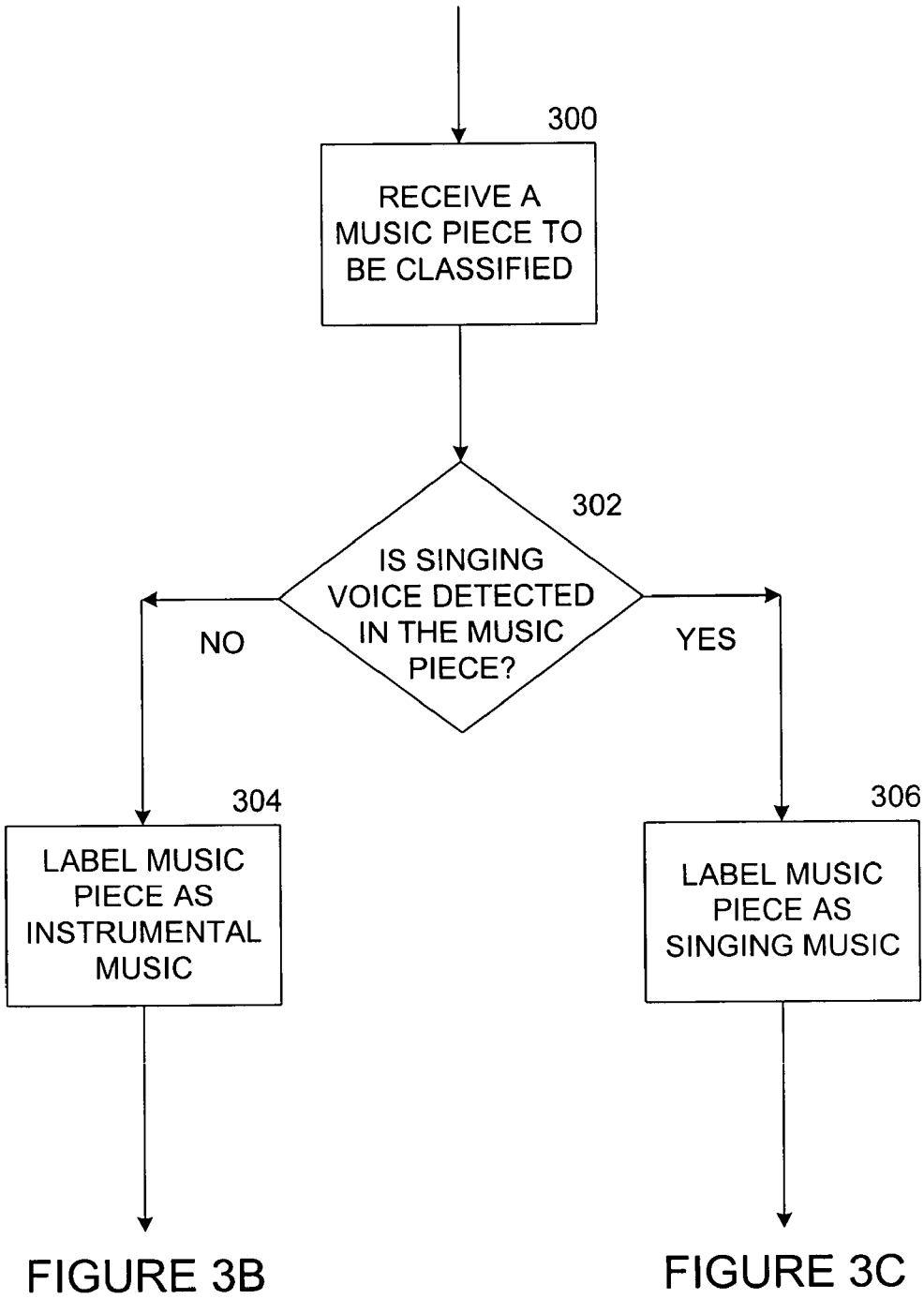
FIG. 3, consisting of FIGS. 3A, 3B, and 3C, shows a block flow chart of an exemplary method for automatic classification of a music piece.
Figure 3B:
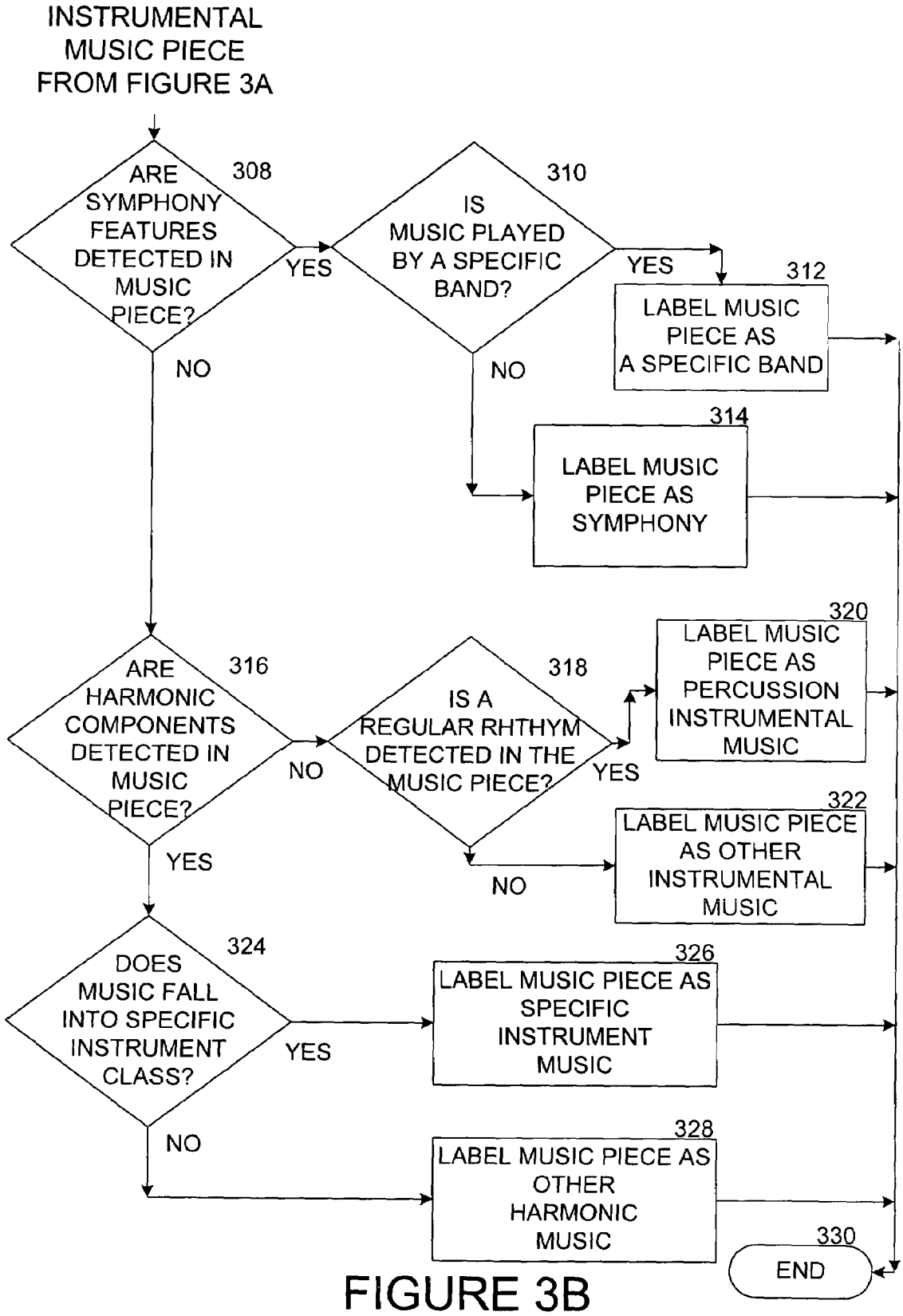
Figure 3C:
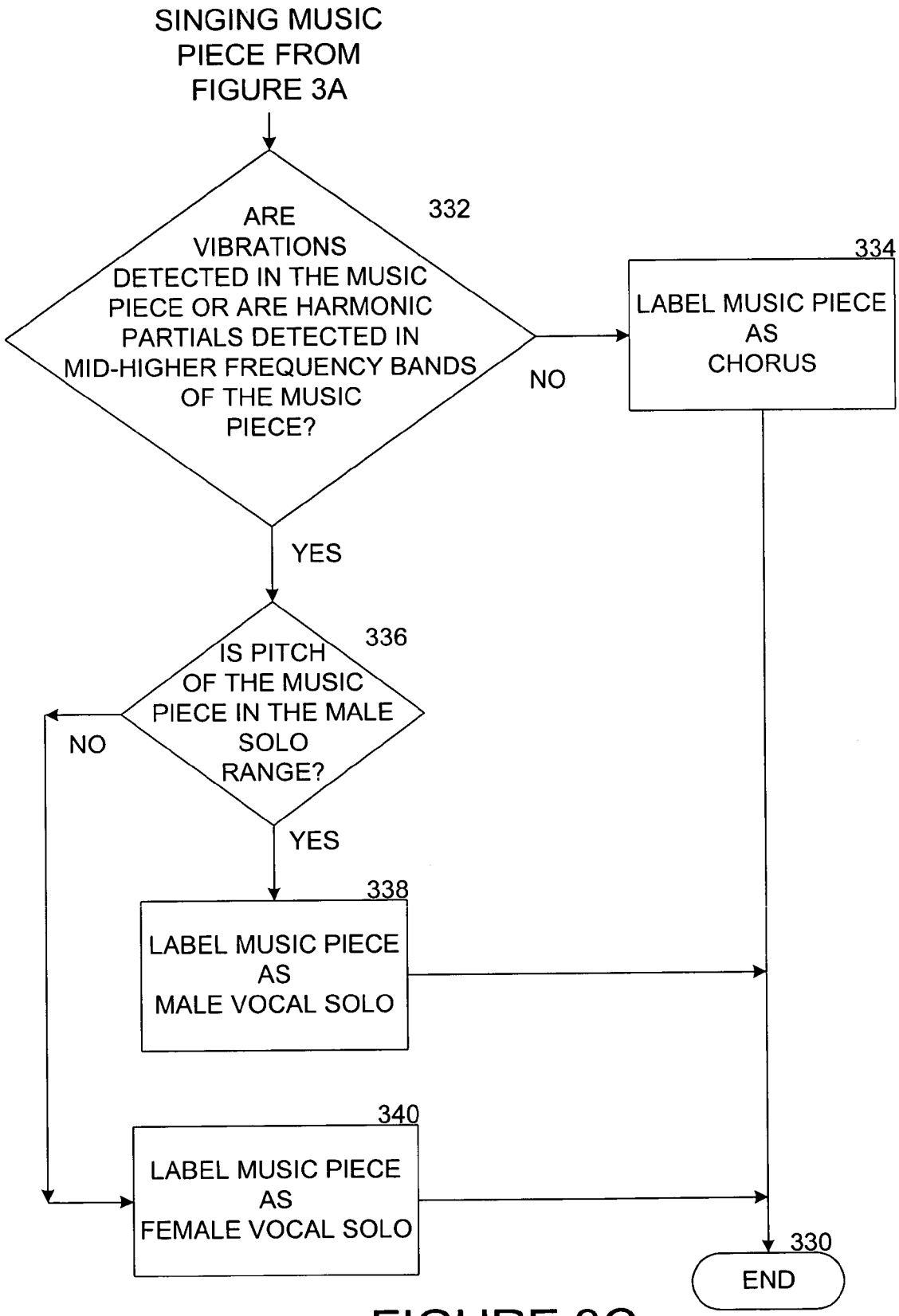

FIG. 3, consisting of FIGS. 3A, 3B, and 3C, shows an exemplary method for automatic classification of music, beginning at step 300 with the reception of a music piece of an event, such as a song or a concert, to be analyzed. Known methods for segmenting music signals from an audiovisual work can be utilized to separate the music portion of an audiovisual work from the non-music portions, such as video or background noise. The received music piece can comprise a segment of a musical work; an entire musical work, such as a song; or a combination of musical segments and/or songs. One method for parsing music signals from an audiovisual work comprised of both music and non-music signals is discussed in Chapter 4, *Generic Audio Data Segmentation and Indexing* in CONTENT-BASED AUDIO CLASSIFICATION AND RETRIEVAL FOR AUDIOVISUAL DATA PARSING, the contents of which are incorporated herein by reference.

At step 302, the received music piece is processed to determine whether a human singing voice is detected in the piece. This categorization of the music piece 200 is shown in the second hierarchical level of FIG. 2 as classifying the music piece 200 into either an instrumental music piece 202 or a singing music piece 226. While FIGS. 2 and 3 show classifying a music piece 200 into one of the two classes of instrumental 202 or singing 226, exemplary embodiments are not so limited. Utilizing the methods disclosed herein, each of the hierarchies of music as shown in FIG. 2 can be expanded, reduced, or relabeled; and additional hierarchical levels can be included, without detracting from the exemplary features of the music classification system.

Figure 4:
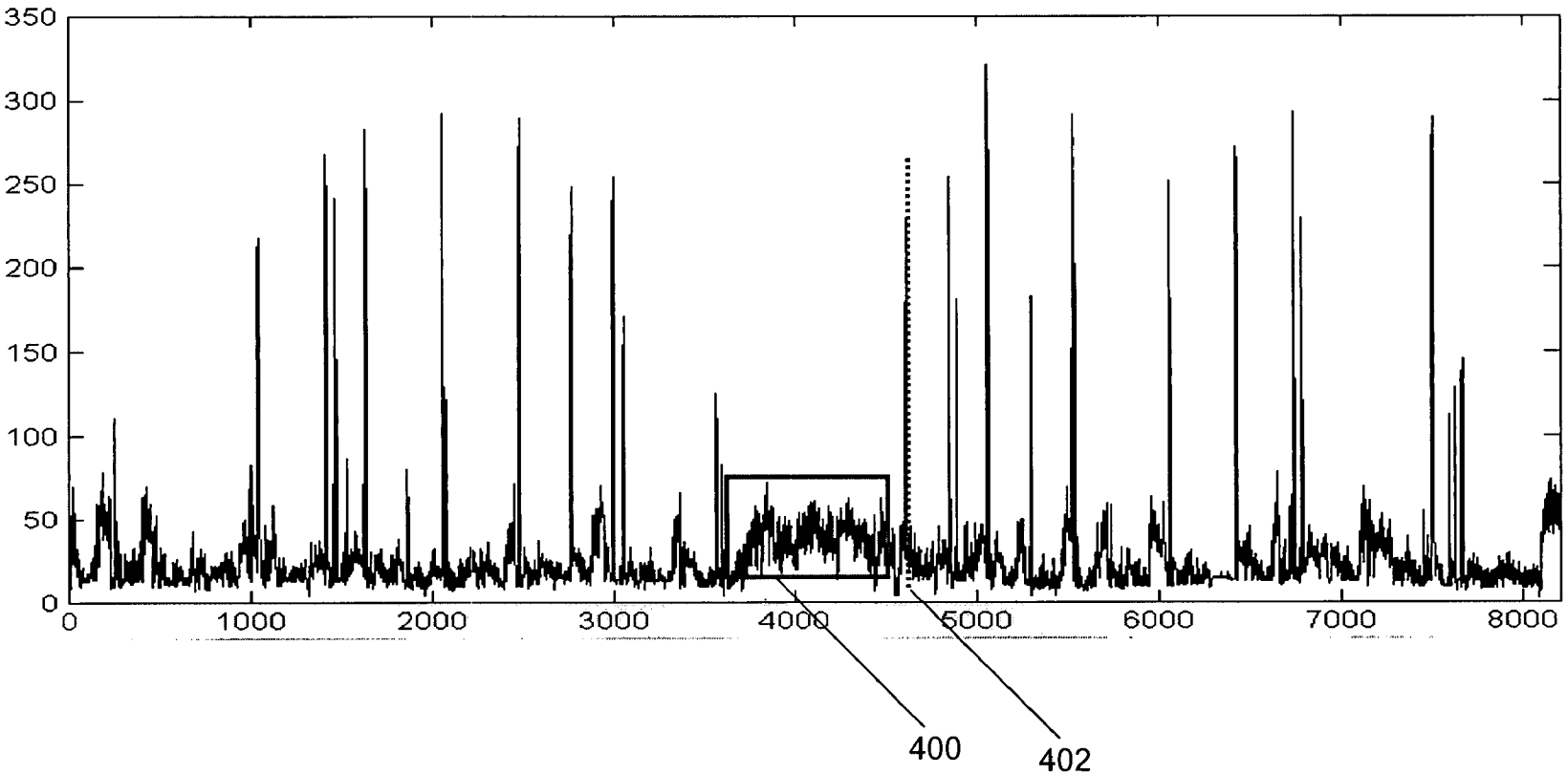
FIG. 4 shows the waveform of short-time average zero-crossing rates of an audio track.

A copending patent application by the inventor of these exemplary embodiments, filed Sep. 30, 2002 under Ser. No. 10/018,129, and entitled SYSTEM AND METHOD FOR GENERATING AN AUDIO THUMBNAIL OF AN AUDIO TRACK, the contents of which are incorporated herein by reference, presents a method for determining whether an audio piece contains a human voice. In particular, analysis of the zero-crossing rate of the audio signals can indicate whether an audio track includes a human voice. In the context of discrete-time audio signals, a "zero-crossing" is said to occur if successive audio samples have different signs. The rate at which zero-crossings (hereinafter "ZCR") occur can be a measure of the frequency content of a signal. While ZCR values of instrumental music are normally within a small range, a singing voice is generally indicated by high amplitude ZCR peaks, due to unvoiced components (e.g. consonants) in the singing signal. Therefore, by analyzing the variances of the ZCR values for an audio track, the presence of human voice on the audio track can be detected. One example of application of the ZCR method is illustrated in FIG. 4, wherein the waveform of short-time average zero-crossing rates of a song is shown, with the y-axis representing the amplitude of the ZCR rates and the x-axis showing the signal across time. In the figure, the box 400 indicates an interlude period of the audio track, while the line 402 denotes the start of singing voice following the interlude, at which point the relative increase in ZCR value variances can be seen.

Figure 5A:
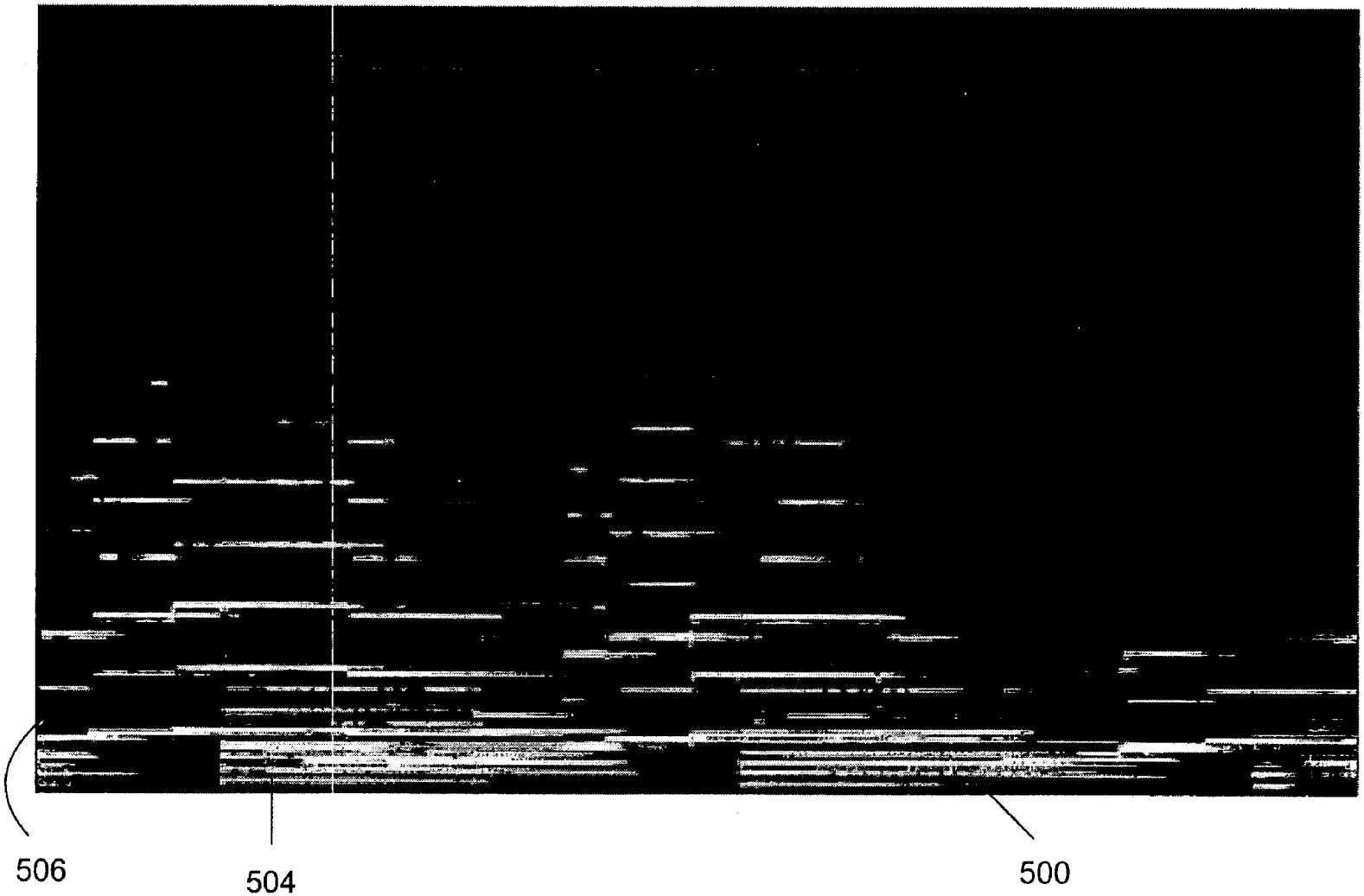
FIG. 5, consisting of FIGS. 5A and 5B, shows spectrograms for an exemplary pure instrumental music piece and an exemplary female voice solo.
Figure 5B:
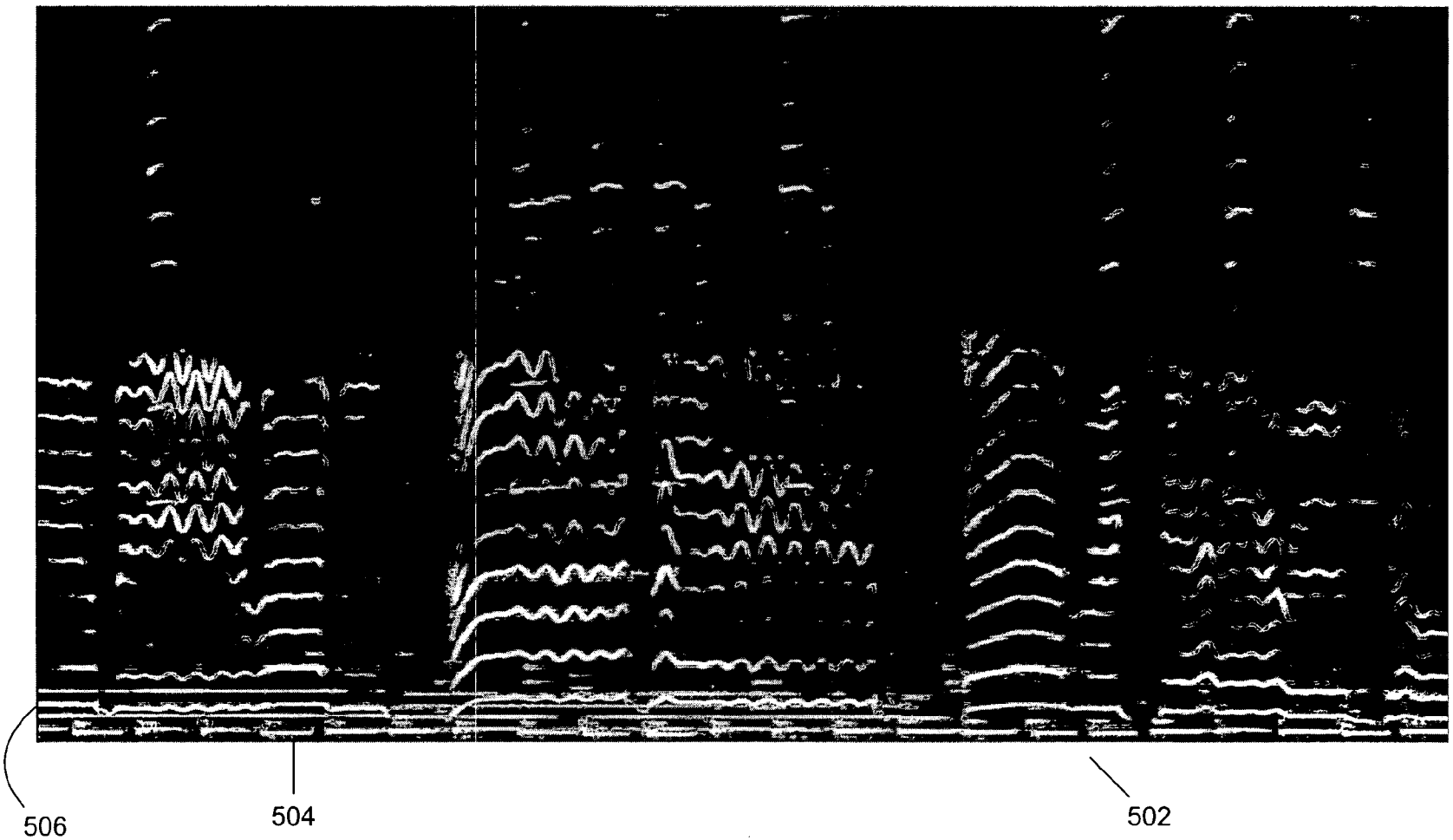
Figure 6A:
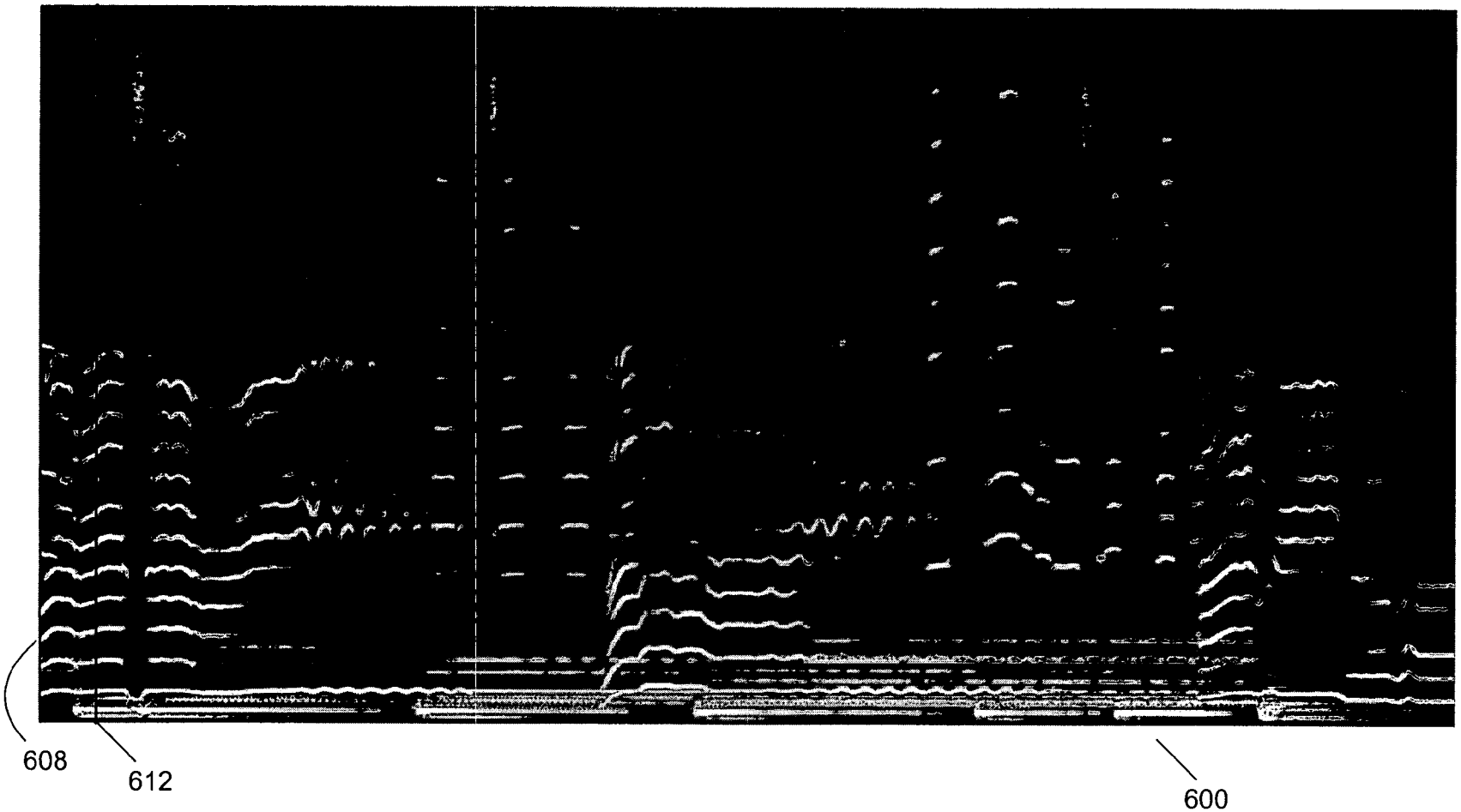
FIG. 6, consisting of FIGS. 6A, 6B, 6C, and 6D, shows spectrograms for a vocal solo and a chorus within a music piece.
Figure 6B:
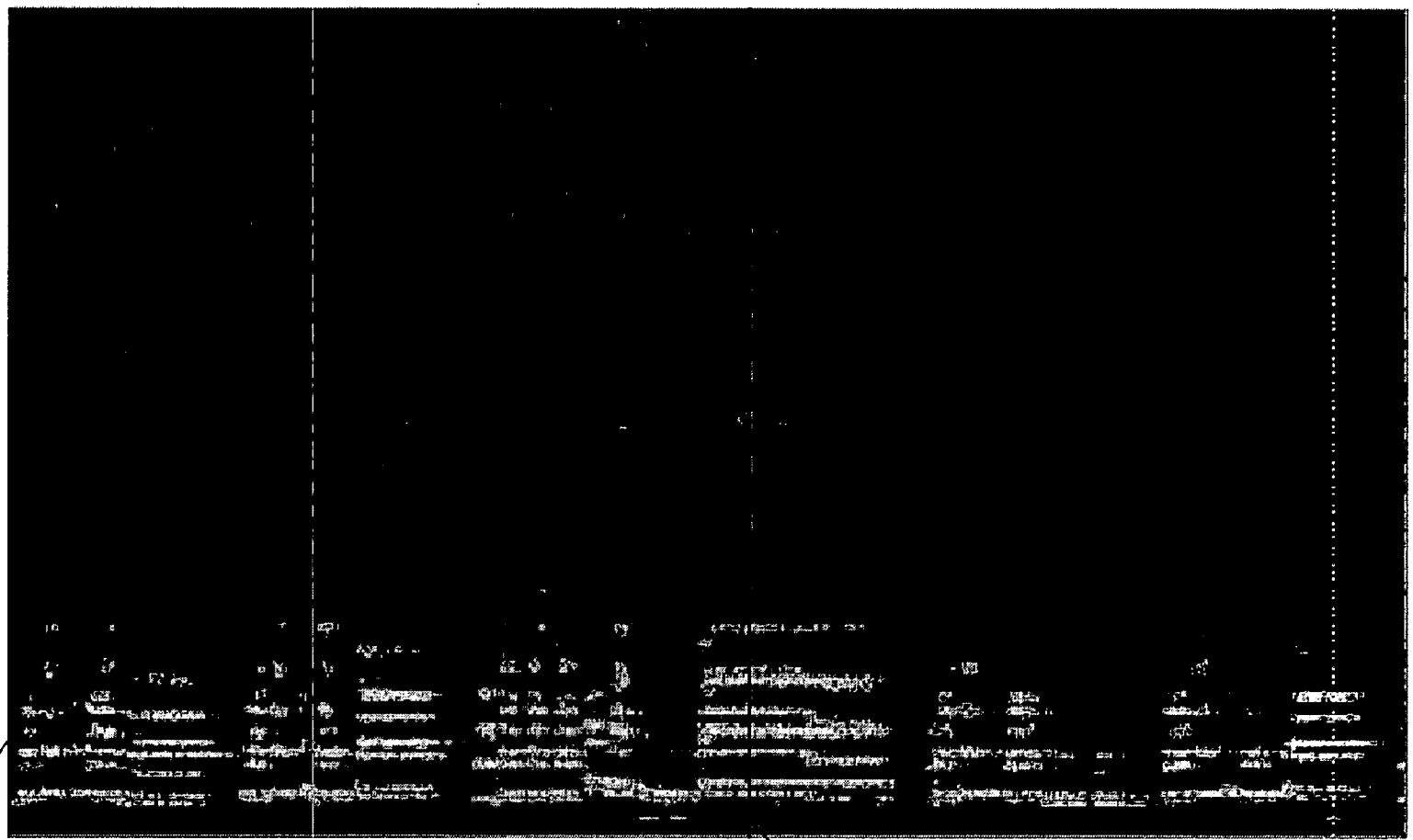
Figure 6C:
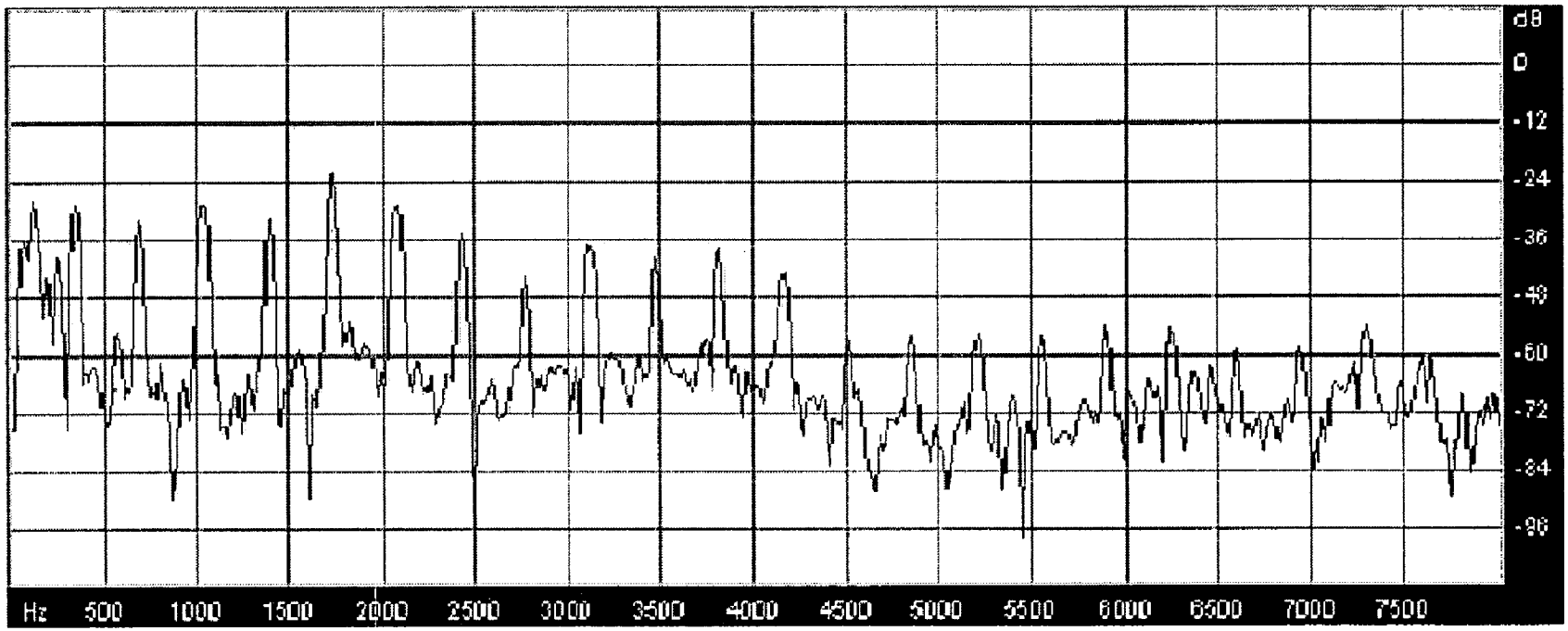
Figure 6D:
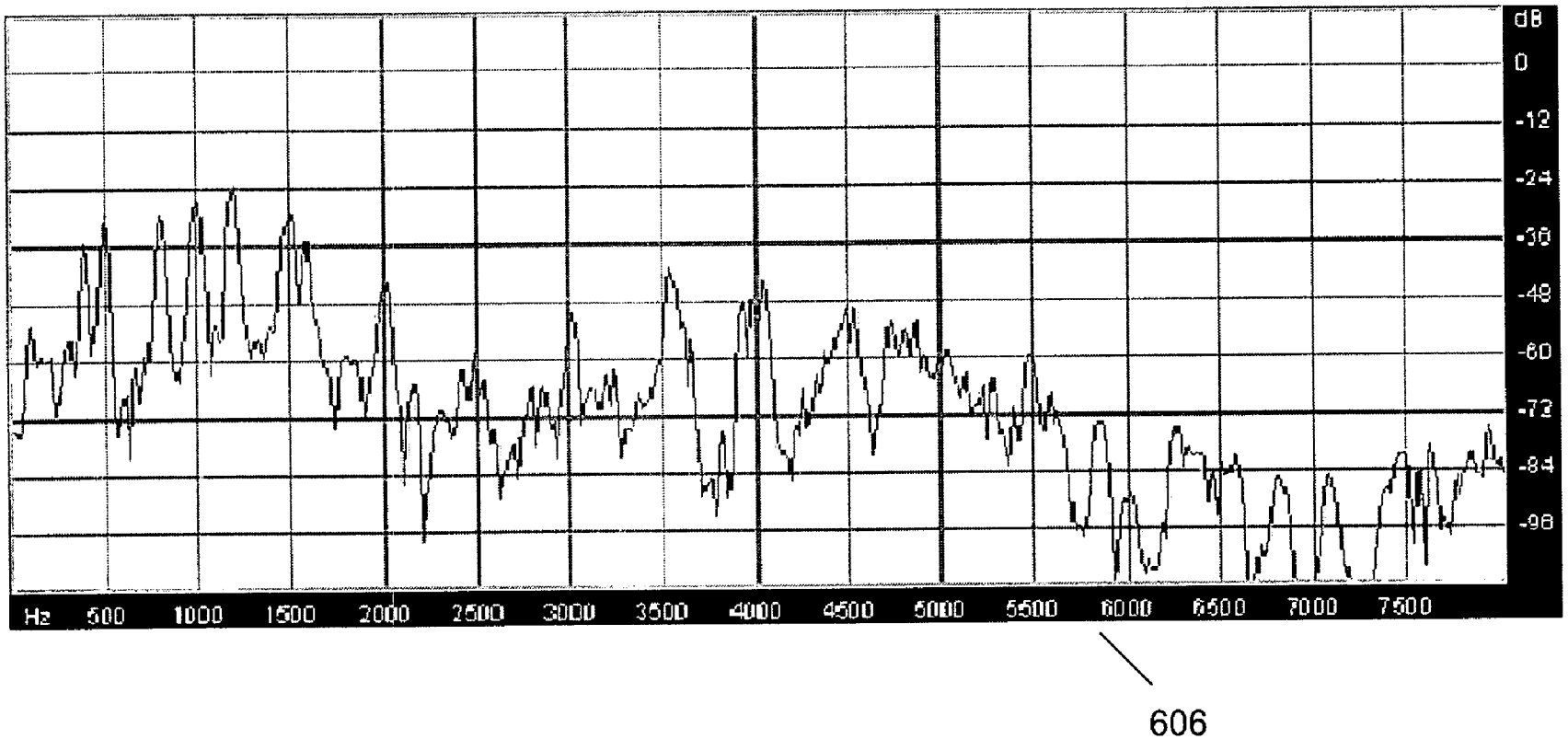

In an alternate embodiment, the presence of a singing human voice on the music piece can be detected by analysis of the spectrogram of the music piece. A spectrogram of an audio signal is a two-dimension representation of the audio signal, as shown in FIGS. 5A and 5B, with the x-axis representing time, or the duration or temporal aspect of the audio signal, and the y-axis representing the frequencies of the audio signal. The exemplary spectrogram 500 of FIG. 5A represents an audio signal of pure instrumental music, and the spectrogram 502 of FIG. 5B is that of a female vocal solo. Each note of the respective music pieces is represented by a single column 504 of multiple bars 506. Each bar 506 of the spectrograms 500 and 502 is a spectral peak track representing the audio signal of a particular, fixed pitch or frequency of a note across a contiguous span of time, i.e. the temporal duration of the note. Each audio bar 506 can also be termed a "partial" in that the audio bar 506 represents a finite portion of the note or sound within an audio signal. The column 504 of partials 506 at a given time represents the frequencies of a note in the audio signal at that interval of time.

The luminance of each pixel in the partials 506 represents the amplitude or energy of the audio signal at the corresponding time and frequency. For example, under a gray-scale image pattern, a whiter pixel represents an element with higher energy, and a darker pixel represents a lower energy element. Accordingly, under a gray scale imaging, the brighter a partial 506 is, the more energy the audio signal has at that point in time and frequency. The energy can be perceived in one embodiment as the volume of the note. While instrumental music can be indicated by stable frequency levels such as shown in spectrogram 500, human voice(s) in singing can be revealed by spectral peak tracks with changing pitches and frequencies, and/or regular peaks and troughs in the energy function, as shown in spectrogram 502. If the frequencies of a large percent of the spectral peak tracks of the music piece change significantly over time (due to the pronunciations of vowels and vibrations of vocal chords), it is likely that the music track includes at least one singing voice.

The likelihood, or probability, that the music track includes a singing voice, based on the zero-crossing rate and/or the frequency changes, can be selected by the user as a parameter for controlling the classification of the music piece. For example, the user can select a threshold of 95 percent, wherein only those music pieces that are determined at step 302 to have at least a 95 percent likelihood that the music piece includes singing are actually classified as singing and passed to step 306 to be labeled as singing music. By making such a probability selection, the user can modify the selection/classification criteria and adjust how many music pieces will be classified as a singing music piece, or as any other category.

If a singing voice is detected at step 302, the music piece is labeled as singing music at step 306, and processing of the singing music piece proceeds at step 332 of FIG. 3C. Otherwise, in the absence of a singing voice being detected at step 302, the music piece defaults to be an instrumental music piece and is so labeled at step 304. The processing of the instrumental music piece continues at step 308 of FIG. 3B.

Referring next to step 332 of FIG. 3C and the classification split at 226 of FIG. 2, the singing music pieces are separated into classes of "vocal solo" and "chorus," with a chorus comprising a song by two or more artists. Referring to FIG. 6, consisting of FIGS. 6A, 6B, 6C, and 6D, there is shown a comparison of spectrograms of a female vocal solo 600 of FIG. 6A and of a chorus 602 of FIG. 6B. The spectral peak tracks 608 of the vocal solo 600 appear as ripples because of the frequency vibrations from the vocal chords of a solo voice. In contrast, the spectral peak tracks 610 of a chorus 602 have flatter ripples because the respective vibrations of the different singers in a chorus tend to offset each other. Further, the spectral peak tracks 610 of the chorus music piece 602 are thicker than the spectral peak tracks 608 of the solo singer due to the mix of the different singers'voices because the partials of the voices in the mid to higher frequency bands overlap with each other in the frequency domain. Accordingly, by evaluating the spectrogram of the music piece, a determination can be made whether the singing is by a chorus or a solo artist. One method by which to detect ripples in the spectral peak tracks 608 is to calculate the first-order derivative of the frequency value of each track 608. The ripples 608 indicative of vocal chord vibrations in a solo spectrogram are reflected as a regular pattern in which positive and negative derivative values appear alternatively. In contrast, the frequency value derivatives of the spectral peak tracks 610 in a chorus are commonly near zero.

In an alternative embodiment, a singing music piece can be classified as chorus or solo by examining the peaks in the spectrum of the music piece. Spectrum graphs 604 of FIG. 6C for a solo piece and 606 of FIG. 6D for a chorus piece respectively chart the spectrum of the two music pieces at certain moments 612 and 614. The music signals at moments 612 and 614 are mapped in graphs 604 and 606 according to their respective frequency in Hz (x axis) and volume, or sound intensity, in dB (y axis). Graph 604 of the solo music piece shows that there are volume spikes of harmonic partials denoted by significant peaks in sound intensity in the spectrum of the solo signal until approximately the 6500 Hz range.

In contrast, the graph 606 for the chorus shows that the peaks indicative of harmonic partials are generally not found beyond the 2000 Hz to 3000 Hz range. While volume peaks can be found above the 2000–3000 Hz range, these higher peaks are not indicative of harmonic partials because they do not have a common divisor of a fundamental frequency or because they are not prominent enough in terms of height and sharpness. In a chorus music piece, individual partials offset each other, especially at higher frequency ranges; so there are fewer spikes, or significant harmonic partials, in the spectrum for the music piece than are found in a solo music piece. Accordingly, significant (e.g., more than five) peaks of harmonic partials occurring above the 2000–3000 Hz range can be indicative of a vocal solo. If a chorus is indicated in the music piece, whether by the lack of vibrations at step 332 or by the absence of harmonic partials occurring above the 2000–3000 Hz range, the music piece is labeled as chorus at step 334, and the classification for this music piece can conclude at step 330.

For music pieces classified as solo music pieces, a further level of classification can be performed by splitting the music piece between male or female singers, as shown at 230 of FIG. 2. This gender classification occurs at step 336 by analyzing the range of pitch values in the music piece. For example, the pitch of the singer's voice can be estimated every 500 ms during the song. If most of the pitch values (e.g., over 80 percent) are lower than a predetermined first threshold (e.g. 250 Hz), and at least some of the pitch values (e.g., no less than 10 percent) are lower than a predetermined second threshold (e.g. 200 Hz), the song is determined to be sung by a male artist; and the music piece is labeled at step 338 as a male vocal solo. Otherwise, the music piece is labeled at step 340 as a female vocal solo. The pitch thresholds and the probability percentages can be set and/or modified by the user by means of an interface to customize and/or control the classification process. For example, if the user is browsing for a male singer whose normal pitch is somewhat high, the user can set the threshold frequencies to be 300 Hz and 250 Hz, respectively.

Figure 7A:
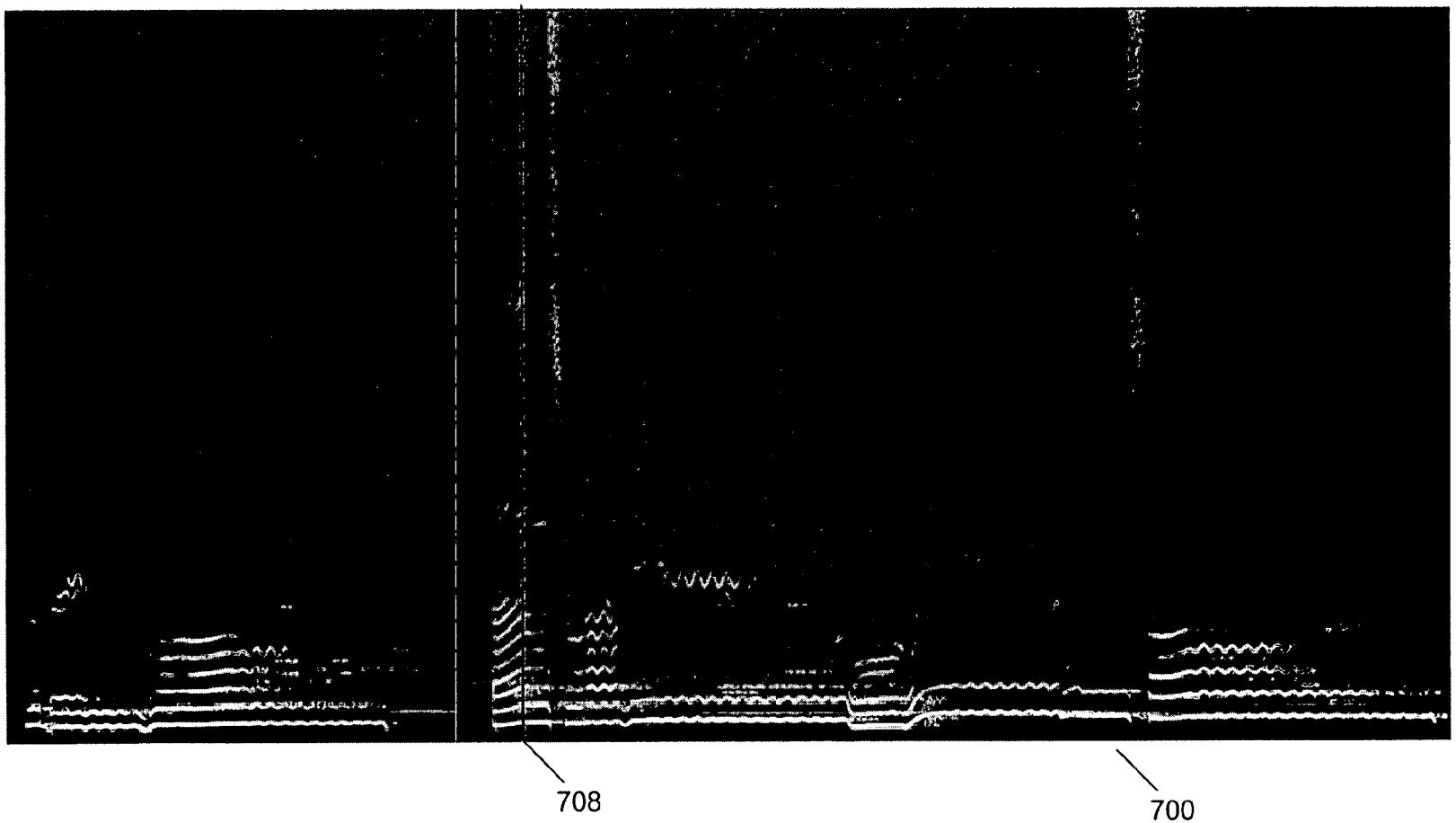
FIG. 7, consisting of FIGS. 7A, 7B, 7C, and 7D, shows spectrograms for a male vocal solo and a female vocal solo.
Figure 7B:
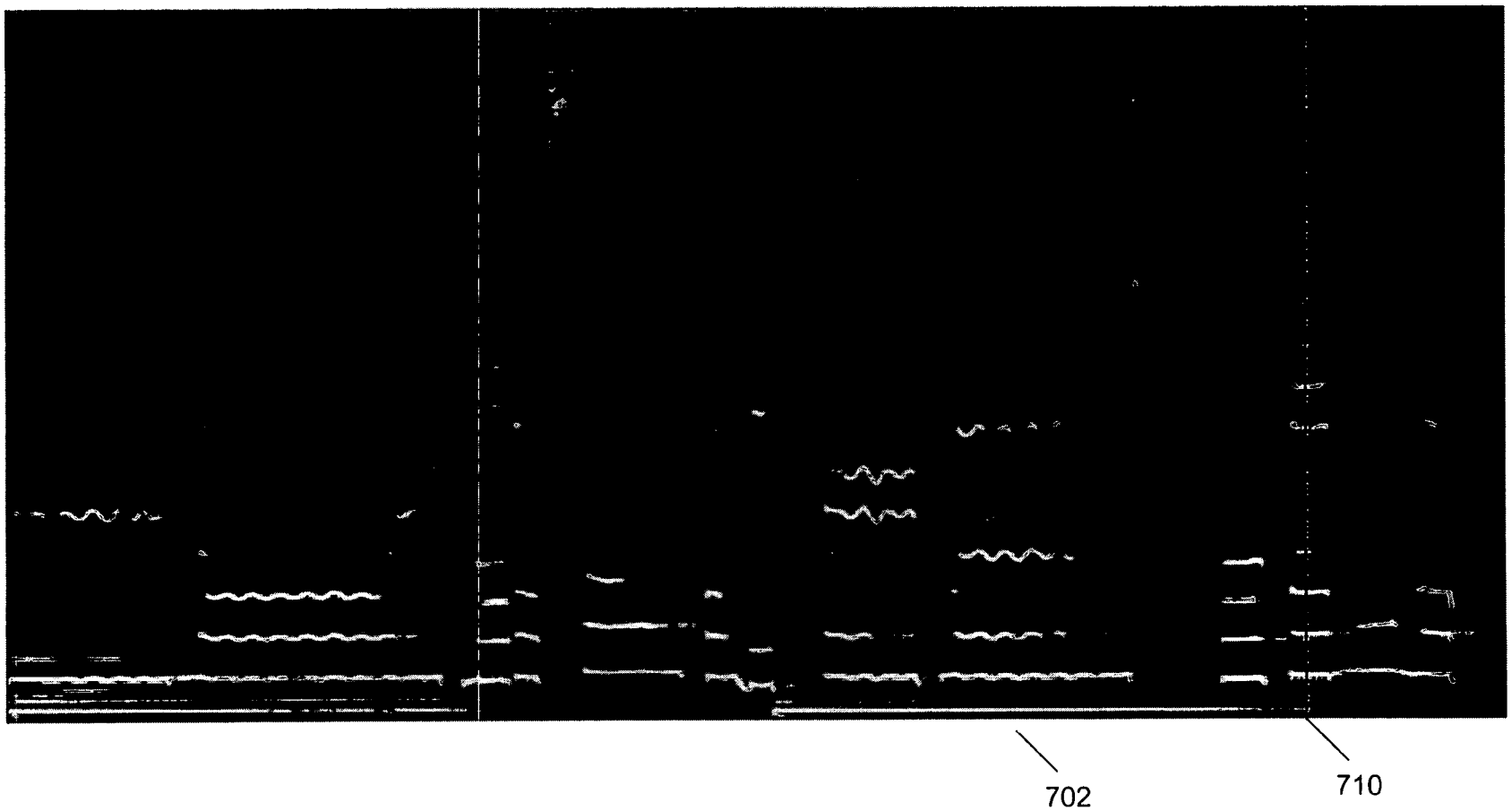
Figure 7C:
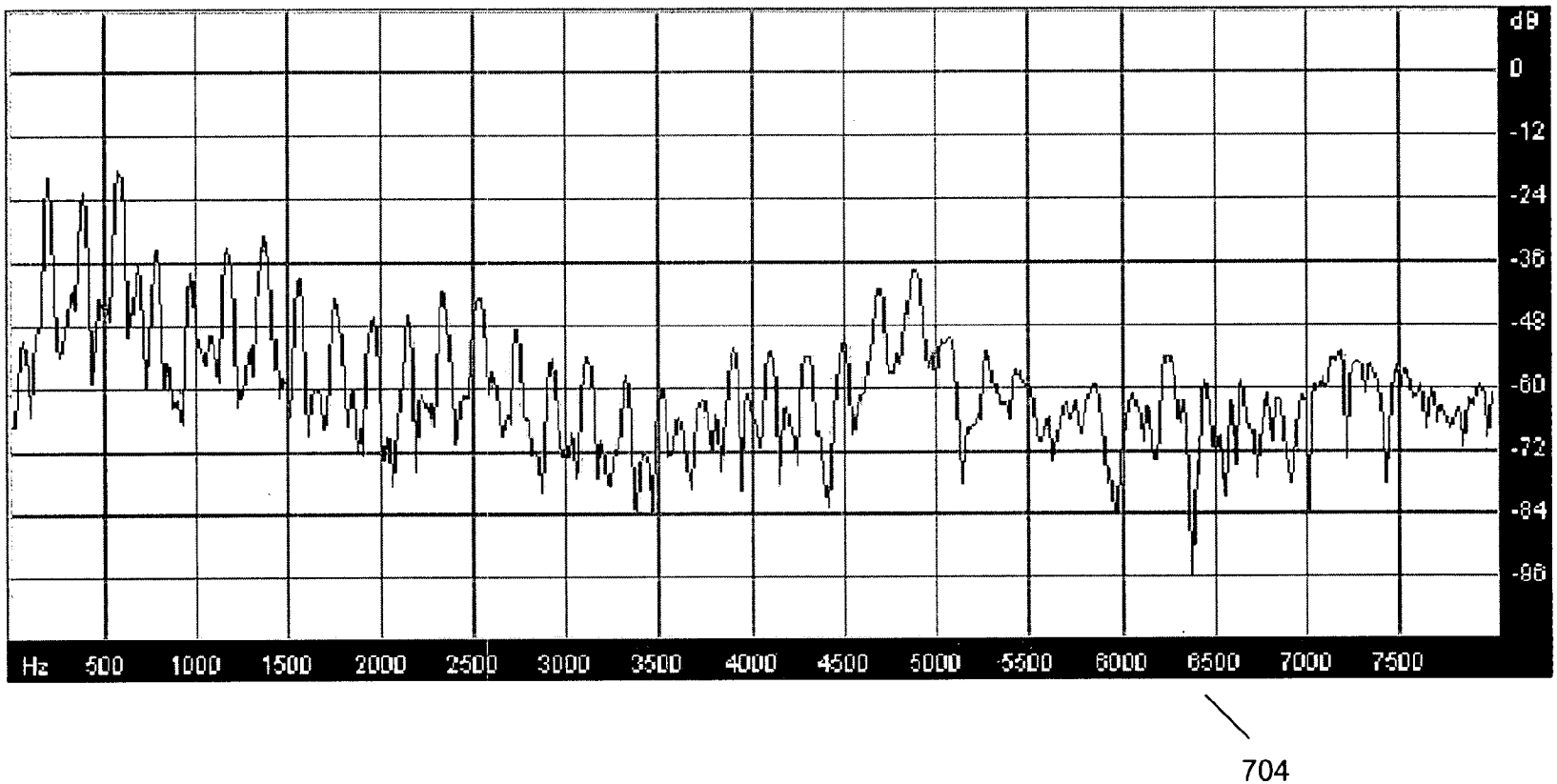
Figure 7D:
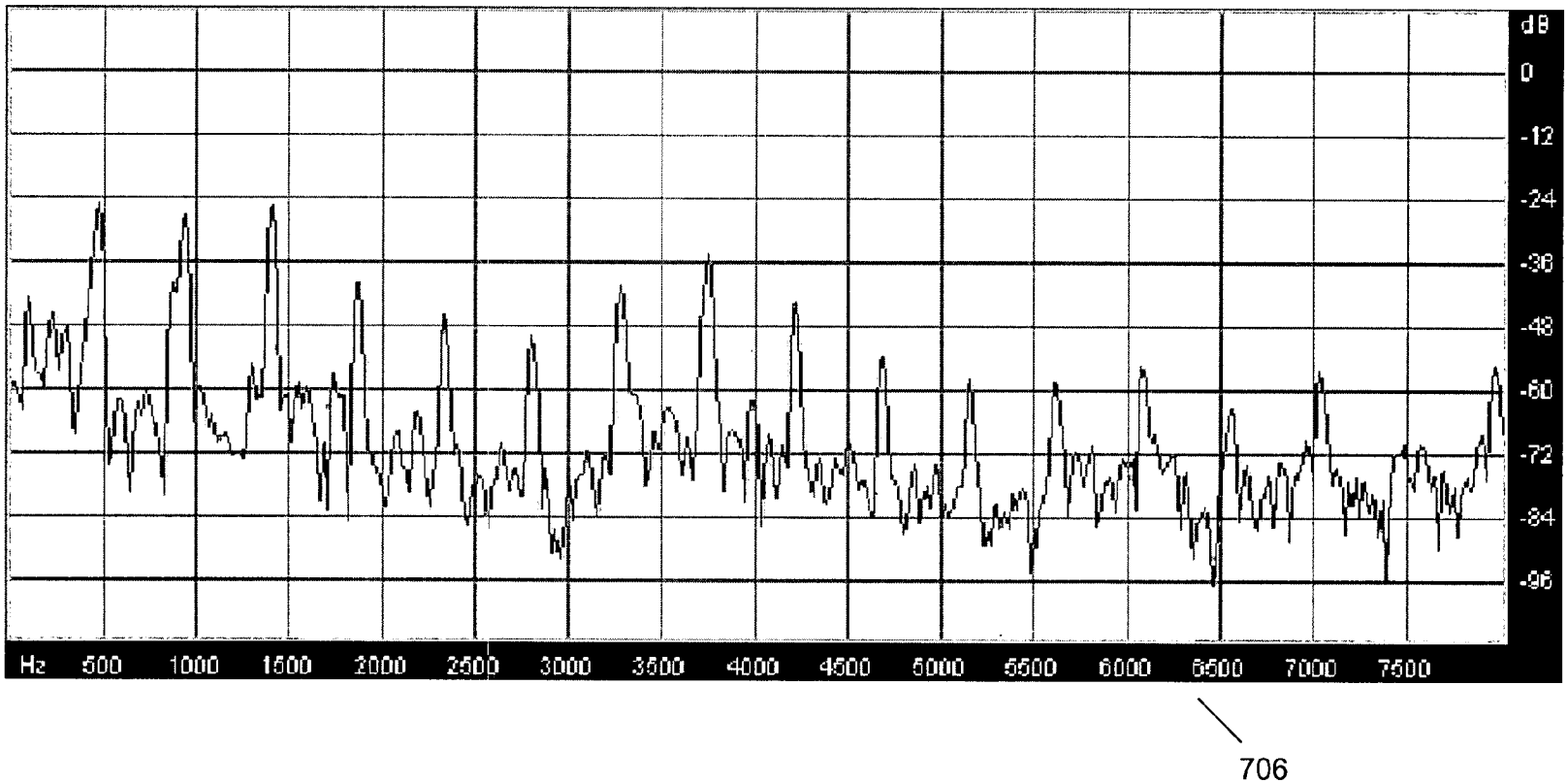

Spectrogram examples of a male solo 700 and a female solo 702 are shown in FIGS. 7A and 7B, respectively. Corresponding spectrum graphs, in frequency Hz and volume dB, are shown in FIGS. 7C and 7D. The spectrum at moment 708 of FIG. 7A is shown in the graph 704 of FIG. 7C for the male solo, and the spectrum at moment 710 of FIG. 7B is shown in the graph 706 of FIG. 7D for the female solo. The pitch of each note is the average interval, in frequency, between neighboring harmonic peaks. For example, the male solo spectrum chart 704 shows a pitch of approximately 180 Hz versus the approximate pitch of 480 Hz of the female solo pitch spectrum chart 706. By evaluating the pitch range of the music piece, exemplary embodiments can classify the music piece as being a female solo 232 or a male solo 234.

While not shown in FIG. 3C, the user has the option of selecting both choruses and vocal solos by language. This classification of the hierarchy of a music piece is shown in FIG. 2 at 234 where the music piece can be classified, for example, among Chinese 236, English 238, and Spanish 240. In this embodiment, the music piece is processed by a language translater to determine the language in which the music piece is being sung; and the music piece is labeled accordingly. For example, the user can select only those solo pieces sung in either English or Spanish. Alternately, this and others of the control parameters can process in the negative in that the user can elect to select all works except those in the English and Spanish languages, for example.

Referring again to FIG. 3B, the further classification of an instrumental music piece according to exemplary embodiments will be disclosed. At step 308, the music piece is analyzed for occurrences of any features indicative of a symphony in the music piece. Within the meaning of exemplary embodiments, a symphony is defined as a music piece for a large orchestra, usually in four movements. A movement is defined as a self-contained segment of a larger work, found in such works as sonatas, symphonies, concertos, and the like. Another related term is form, wherein the form of a symphonic piece is the structure of the composition, as characterized by repetition, by contrast, and by variation over time. Examples of specific symphonic forms include sonata-allegro form, binary form, rondo form, etc. Another characteristic feature of symphonies is regularities in the movements of the symphonies. For example, the first movement of a symphony is usually a fairly fast movement, weighty in content and feeling. The vast majority of first movements are in sonata form. The second movement in most symphonies is slow and solemn in character. Because a symphony is comprised of multiple movements and repetitions, the music signal of a symphony alternates over time between a relatively high volume audio signal (performance of the entire orchestra) and a relatively low volume audio signal (performance of a single or a few instruments of the orchestra). Analyzing the content of the music piece for these features that are indicative of symphonies can be used to detect a symphony in the music piece.

Figure 8:
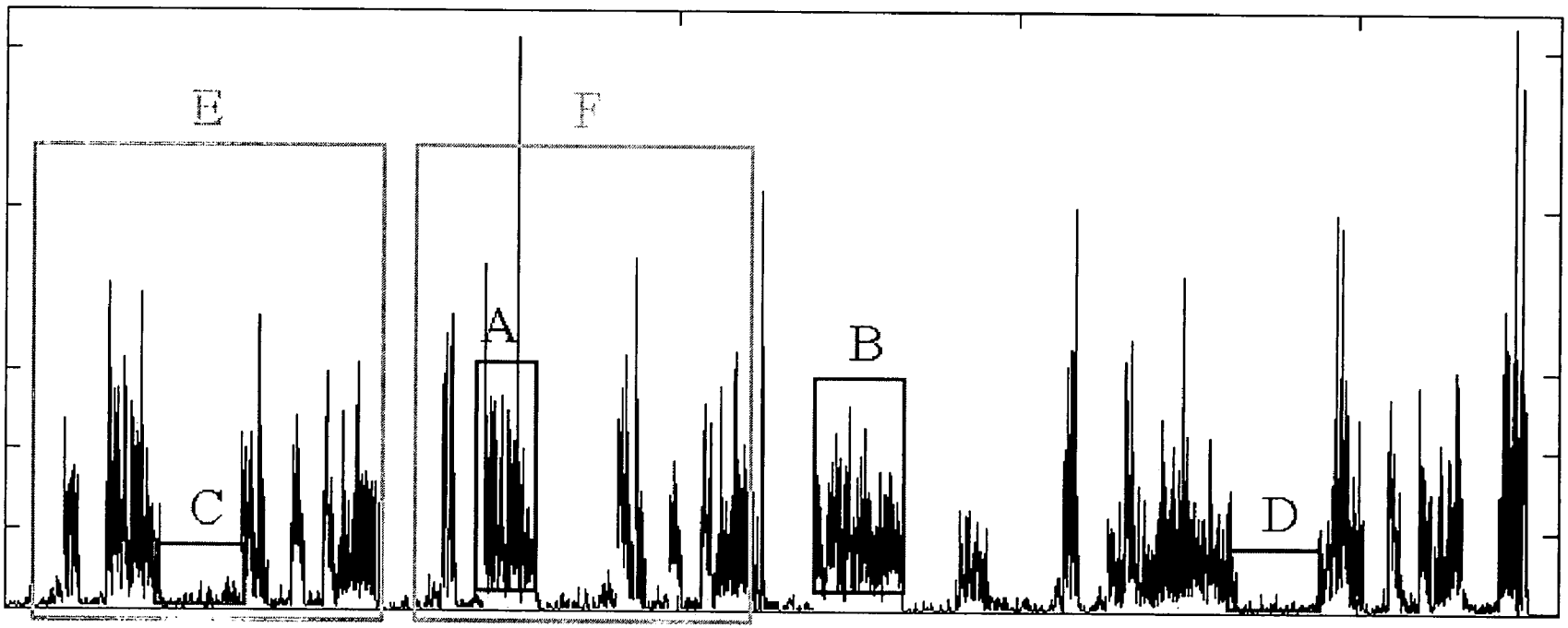
FIG. 8 shows the energy function of a symphony music piece.

Referring also to FIG. 8, there is shown the energy function of a symphonic music piece over time. Shown in boxes A and B are examples of high volume signal intervals which have two distinctive features, namely (i) the average energy of the interval is higher than a certain threshold level $T_1$ because the entire orchestra is performing and (ii) there is no energy lower than a certain threshold level $T_2$ during the interval because different instruments in the orchestra compensate each other, unlike the signal of a single instrument in which there might be a dip in energy between two neighboring notes. The energy peaks shown in boxes C and D are examples of low volume signal intervals which (iii) have average energy levels lower than a certain threshold $T_3$ because only a few instruments are playing and (iv) have the highest energy in the interval as being lower than a certain threshold $T_4$. The content of box F is a repetition of the audio signals of box E with minor variations. Accordingly, by checking for alternating high volume and low volume intervals, with each interval being longer than certain threshold, and/or checking for repetition(s) of energy level patterns in the whole music piece, symphonies can be detected. One method for detecting repetition of energy patterns in a music piece is to compute the autocorrelation of the energy function as shown in FIG. 8, and the repetition will be reflected as a significant peak in the autocorrelation curve.

Figure 9A:
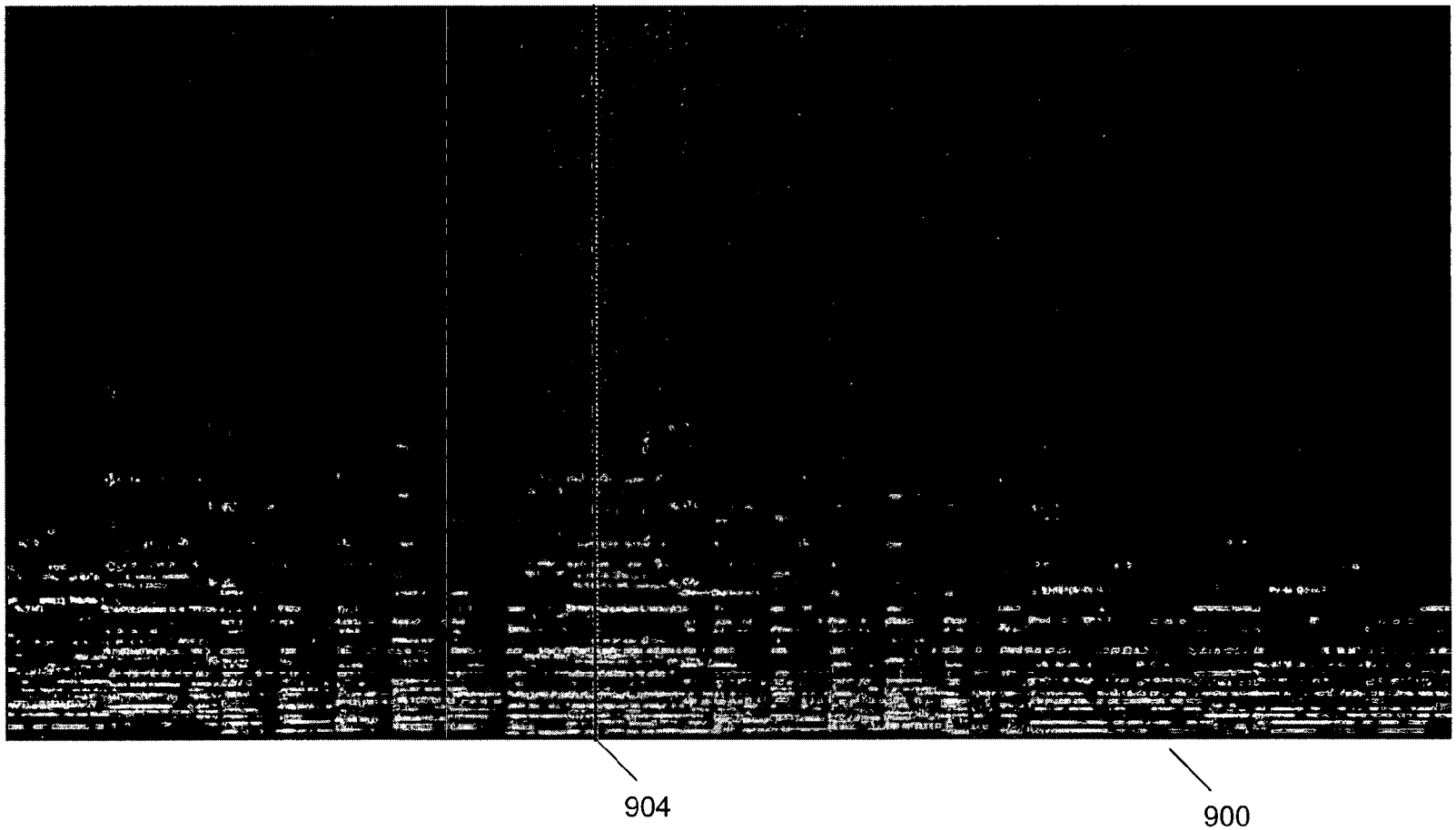
FIG. 9, consisting of FIGS. 9A and 9B, shows the spectrogram and spectrum of a portion of a symphony music piece.
Figure 9B:
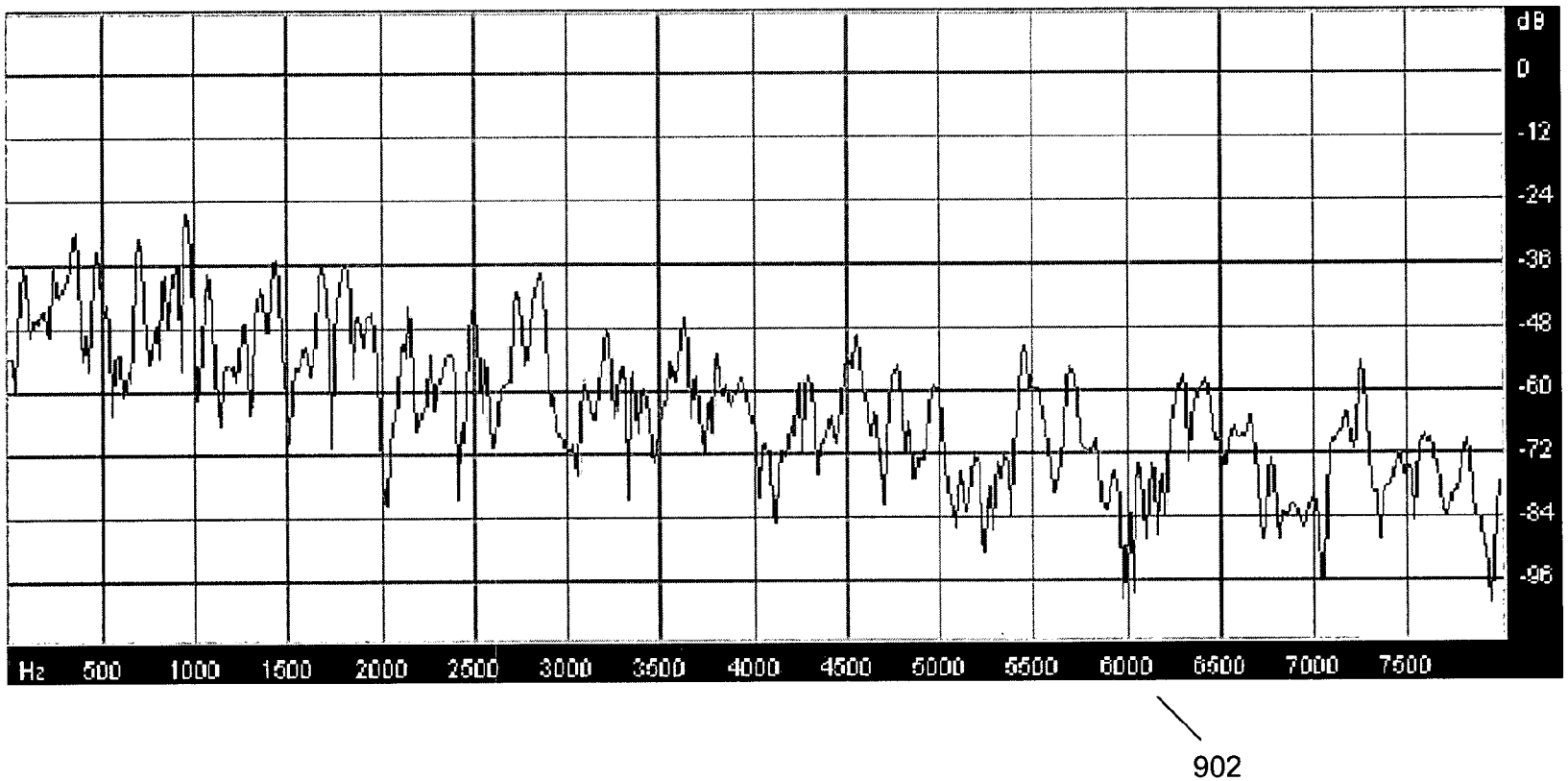

Referring now to FIGS. 9A and 9B, there is respectively shown a spectrogram 900 and a corresponding spectrum 902 of a symphonic music piece. During the high-volume intervals of the symphonic piece, while there are still significant spectral peak tracks which can be detected, the relation among harmonic partials of the same note is not as obvious (as illustrated in the spectrum plot 902) as in music which contains only one or a few instruments. The lack of obvious relation is attributable to the mix of a large number of instruments playing in the symphony and the resultant overlap of the partials of the different instruments with each other in the frequency domain. Therefore, the lack of harmonic partials in the frequency domain in the high-volume range of the music piece is another feature of symphonies, which can be used alone or in combination with the above methods for distinguishing symphonies from other types of instrumental music.

If any of these methods detect features indicative of a symphony, the music piece is labeled at step 314 as a symphony. Optionally, at step 310, the music piece can be analyzed as being played by a specific band. The user can select one or more target bands against which to compare the music piece for a match indicating the piece was played by a specific band. Examples of music pieces by various bands, whether complete musical works or key music segments, can be stored on storage medium 112 for comparison against the music piece for a match. If there is a correlation between the exemplary pieces and the music piece being classified that is within the probability threshold set by the user, then the music piece is labeled at step 312 as being played by a specific band. Alternately, the music piece can be analyzed for characteristics of types of bands. For example, high energy changes within a symphony band sound can be indicative of a rock band. Following steps 312 and 314, the classification process for the music piece ends at step 330.

At step 316, the processing begins for classifying a music piece as having been played by a family of instruments or, alternately, by a particular instrument. The music piece is segmented at step 316 into notes by detecting note onsets, and then harmonic partials are detected for each note. However, if note onsets cannot be detected in most parts of the music piece (e.g. more than 50%) and/or harmonic partials are not detected in most notes (e.g. more than 50%), which can occur in music pieces played with a number of different instruments (e.g. a band), then processing proceeds to step 318 to determine whether a regular rhythm can be detected in the music piece. If a regular rhythm is detected, then the music piece is determined to have been created by one or more percussion instruments; and the music piece is labeled as "percussion instrumental music" at step 320. If no regular rhythm is detected, the music piece is labeled as "other instrumental music" at step 322, and the classification process ends at step 330.

Otherwise, the classification system proceeds to step 324 to identify the instrument family and/or instrument that played the music piece. U.S. Pat. No. 6,476,308, issued Nov. 5, 2002 to the inventor of these exemplary embodiments, entitled METHOD AND APPARATUS FOR CLASSIFYING A MUSICAL PIECE CONTAINING PLURAL NOTES, the contents of which are incorporated herein by reference, presents a method for classifying music pieces according to the types of instruments involved. In particular, various features of the notes in a music piece, such as rising speed (Rs), vibration degree (Vd), brightness (Br), and irregularity (Ir), are calculated and formed into a note feature vector. Some of the feature values are normalized to avoid such influences as note length, loudness, and/or pitch. The note feature vector, with some normalized note features, is processed through one or more neural networks for comparison against sample notes from known instruments to classify the note as belonging to a particular instrument and/or instrument family.

While there are occasional misclassifications among instruments which belong to the same family (e.g. viola and violin), reasonably reliable results can be obtained for categorizing music pieces into instrument families and/or instruments according to the methods presented in the aforementioned patent application. As shown in FIG. 2, the instrument families include the string family 216 (violin, viola, cello, etc.), the wind family 218 (flute, horn, trumpet, etc.), the percussion family 220 (drum, chime, marimba, etc.), and the keyboard family 222 (piano, organ, etc.). Accordingly, the music piece can be classified and labeled in step 326 as being one of a "string instrumental", "wind instrumental", "percussion instrumental," or "keyboard instrumental." If the music piece cannot be classified into one of these four families, it is labeled in step 328 as "other harmonic instrumental" music. Further, probabilities can be generated indicating the likelihood that the audio signals have been produced by a particular instrument, and the music piece can be classified and labeled in step 326 according to user-selectable parameters as having been played by a specific instrument, such as a piano. For example, the user can select as piano music all music pieces with a likelihood of having been played by a piano being higher than 40%.

Some audio formats provide for a header or tag fields within the audio file for information about the music piece. For example, there is a 128 byte TAG at the end of a MP3 music file that has fielded information of title, artist, album, year, genre, etc. Notwithstanding this convention, many MP3 songs lack the TAG entirely or some of the TAG fields may be empty on nonexistent. Nevertheless, when the information does exist, it may be extracted and used in the automatic music classification process. For example, samples in the "other instrumental" category might be further classified into the groups of "instrumental pop", "instrumental rock", and so on based on the genre field of the TAG.

In an alternate embodiment, control parameters can be selected by the user to control the classification and/or the cataloging process. Referring now to the user interface shown in FIG. 10, there is shown on the left side a list of available classification categories with which a user can customize the classification process. The list of categories shown are intended to be exemplary and not limiting and can be increased, decreased, and restructured to accommodate the preferences of the user and the nature and/or source of the music piece(s) to be classified. The user can select by any of known methods for making selections through a user interface, such as clicking a button on a screen with a mouse. In the example shown in FIG. 10, the categories of INSTRUMENTAL, SYMPHONY, ROCK BAND, SINGING, CHORUS, VOCAL SOLO, MALE SOLO, ENGLISH, SPANISH, and FEMALE SOLO have been selected to control the classification process. Under control of the exemplary category parameters of FIG. 10, no male Chinese solos will be classified or selected for storage, but all female solos, including those in Chinese, will be classified and stored The categories are arranged in a user-modifiable, hierarchical structure on the list side 1000 of the interface, and this hierarchical structure is automatically mapped into the tree structure on the hierarchical side 1004 of the interface. The hierarchical structure shown in 1004 represents not only the particular categories and subcategories by which the musical pieces will be classified but also the hierarchical structure of the resultant database or catalog that can be populated by an exemplary embodiment of the classification process.

The classification system can automatically access, download, and/or extract parameters and/or representative patterns or even music pieces from storage 112 to facilitate the classification process. For example, should the user select "piano," the system can select from storage 112 the parameters or patterns characteristic of piano music pieces. Should the user forget to select a parent node within a hierarchical category while selecting a child, the system will include the parent in the hierarchy of 1004. For example, should the user make the selection shown in 1000 but neglect to select SYMPHONY, the system will make the selection for the user to complete the hierarchical structure. While not shown in FIG. 10, the user can select a category in the negative, which instructs the classification system to not select a particular category.

At the end of the classification process, as indicated by step 330 in FIGS. 3B and 3C, the classified music piece(s) can be stored on the storage device 124. The classified music pieces can be stored sequentially on the storage device 124 or can be stored in a hierarchical or categorized format indicative of the structure utilized to classify the music pieces, as shown in the music classification hierarchies of FIGS. 2 and 10. The hierarchical structure for the stored classified music pieces can facilitate subsequent browsing and retrieval of desired music pieces.

In yet another embodiment, the classified music pieces can be tagged with an indicator of their respective classifications. For example, a music piece that has been classified as a female, solo Spanish song can have this information appended to the music piece prior to the classified music piece being output to the storage device 124. This classification information can facilitate subsequent browsing for music pieces that satisfy a desired genre, for example. Alternately, the classification information for each classified music piece can be stored separately from the classified music piece but with a pointer to the corresponding music pieces so the information can be tied to the classified music piece upon demand. In this manner, the content of various catalogs, databases, and hierarchical files of classified music pieces can be evaluated and/or queried by processing the tags alone, which can be more efficient than analyzing the classified music pieces themselves and/or the content of the classified music piece files.

Although exemplary embodiments of the present invention have been shown and described, it will be appreciated by those skilled in the art that changes may be made in these embodiments without departing from the principle and spirit of the invention, the scope of which is defined in the appended claims and their equivalents.

What is claimed is:

1. A method for automatic classification of music, comprising:

receiving a music piece to be classified based on a hierarchy of music classification categories;

determining a music type based on a detection of human singing by analyzing a waveform of the music piece comprising a composite of music components;

labeling the received music piece as singing music when the analyzed waveform is determined to comprise human singing;

labeling the received music piece as instrumental music when the analyzed waveform is not determined to comprise human singing; and classifying and labeling the music piece into a specific category of the determined music type, wherein the music piece labeled as singing music is classified based on at least one of frequency vibrations and spectral peak tracks in the music piece.

2. The method according to claim 1, wherein the received music piece is comprised of at least music sounds, and wherein the music piece can include one or more of audio-visual signals and/or non-music sounds.

3. The method according to claim 1, wherein the presence of human singing on the received music piece is determined by analyzing a spectrogram of the received music piece.

4. The method according to claim 1, including:

classifying the labeled singing music piece as either chorus music or solo music, based on frequency vibrations in the singing music piece.

5. The method according to claim 1, including:

classifying the labeled singing music piece as either chorus music or solo music, based on spectral peak tracks in the singing music piece.

6. The method according to claim 5, wherein the singing music piece is classified as solo music if significant peaks of harmonic partials are found above the 2000–3000 Hz range in the singing music piece.

7. The method according to claim 5, including:

classifying solo music as either male vocal solo or female vocal solo, based on the range of pitch values in the solo music piece.

8. The method according to claim 7, wherein the solo music piece is labeled as male vocal solo if the range of most of the pitch values in the solo music piece are lower than a predetermined first threshold and if at least some of the pitch values in the solo music piece are lower than a predetermined second value, wherein the second threshold is a lower pitch value than the first threshold.

9. The method according to claim 8, wherein the solo music piece is labeled as female vocal solo if the solo music piece does not satisfy the pitch range thresholds for male solo vocal.

10. The method according to claim 1, wherein the labeled instrumental music piece is analyzed for occurrences of features indicative of symphonies, and wherein if at least one symphony feature is detected in the instrumental music piece, the instrumental music piece is labeled as symphony.

11. The method according to claim 10, wherein the symphony features include repetition, contrast, and variation of music signal or energy over time; sonata-allegro form; binary form; rondo form; regularities in movements; and alternating high and low volume intervals.

12. The method according to claim 10, including comparing the symphony music piece against one or more music segments exemplary of a specific band, wherein the symphony music piece is labeled as a specific band music piece if the symphony music piece matches at least one exemplary music segment.

13. The method according to claim 10, when the instrumental music piece has not been labeled as symphony, comprising:

segmenting the instrumental music piece into notes by detecting note onsets; and detecting harmonic partials for each segmented note, wherein if note onsets cannot be detected in most notes of the music piece and/or harmonic partials cannot be detected in most notes of the music piece, then labeling the instrumental music piece as other instrumental music.

14. The method according to claim 13, when the instrumental music piece has not been labeled as other instrumental music, comprising:

comparing note feature values of the instrumental music piece as matching sample notes of an instrument, wherein when the note feature values of the instrumental music piece match the sample notes of the instrument, labeling the instrumental music piece as the specific matched instrument, and otherwise labeling the instrumental music piece as other harmonic music.

15. The method according to claim 1, wherein the labeled music piece is written into a library of classified music pieces.

16. The method according to claim 15, wherein the labeling and/or the writing of the labeled music piece is controlled by parameters selected by a user.

17. The method according to claim 16, wherein the user selects a hierarchical structure of categories for controlling the classification of the music piece.

18. The method according to claim 17, wherein the labeled music piece is written into a hierarchical database according to the structure selected by the user and wherein the labeled music pieces in the hierarchical database can be browsed according to the hierarchy.

19. A method for classification of music, comprising:

selecting parameters for controlling the classification of a music piece, wherein the selected parameters establish a hierarchy of categories for classifying the music piece into at least a music type having specific categories;

determining, in a hierarchical order and for each selected category, when the music piece satisfies the category by analyzing a waveform of the music piece comprising a composite of music components, a music piece being classified based on at least one of frequency vibrations and spectral peak tracks in the music piece;

labeling the music piece with each selected category of a music type satisfied by the music piece; and when the music piece satisfies at least one selected category of a music type, writing the labeled music piece into a library according to a hierarchy of the categories satisfied by the music piece.

20. The method according to claim 19, including:

selecting parameters for subsequent browsing of the library for desired music pieces.

21. The method according to claim 19, wherein the categories include instrumental, singing music, symphony, a specific band, specific instrument music, other harmonic music, chorus, and vocal solo.

22. A computer-based system for automatic classification of music, comprising:

a device configured to receive a music piece to be classified based on a hierarchy of music classification categories; and a computer configured to:

determine a music type based on a detection of human singing by analyzing a waveform of the music piece comprising a composite of music components;

label the received music piece as singing music when the analyzed waveform is determined to comprise human singing;

label the received music piece as instrumental music when the analyzed waveform is not determined to comprise human singing; and classify and label the music piece into a specific category of the determined music type to write the labeled music piece into a library of classified music pieces, wherein the music piece labeled as singing music is classified based on at least one of frequency vibrations and spectral peak tracks in the music piece.

23. The method according to claim 22, wherein the presence of human singing on the received music piece is determined by analyzing a spectrogram of the received music piece.

24. The method according to claim 22, including:

classifying the labeled singing music piece as either chorus music or solo music, based on frequency vibrations in the singing music piece.

25. The method according to claim 22, including:

classifying the labeled singing music piece as either chorus music or solo music, based on spectral peak tracks in the singing music piece.

26. The method according to claim 25, including:

classifying solo music as either male vocal solo or female vocal solo, based on the range of pitch values in the solo music piece.

27. The method according to claim 22, wherein the labeled instrumental music piece is analyzed for occurrences of features indicative of symphonies, and wherein if at least one symphony feature is detected in the instrumental music piece, the instrumental music piece is labeled as symphony.

28. The method according to claim 27, including comparing the symphony music piece against one or more music segments exemplary of a specific band, wherein the symphony music piece is labeled as a specific band music piece if the symphony music piece matches at least one exemplary music segment.

29. The method according to claim 22, wherein the labeling and/or the writing of the labeled music piece is controlled by parameters selected by a user.

30. The system according to claim 29, including an interface configured to select parameters for controlling the classification of the music.

31. A system for automatically classifying a music piece, comprising:

means for receiving a music piece of a music type to be classified based on a hierarchy of music classification categories;

means for selecting categories of the music type to control the classifying of the received music piece; and means for classifying the received music piece based on the selected categories, wherein the music piece is classified based on at least one of frequency vibrations and spectral peak tracks in the music piece.

32. The system according to claim 31, including means for labeling the classified music piece as a particular category of music.

33. The system according to claim 31, including means for selecting control parameters to control, adjust, and/or customize the classifying of the music piece.

34. A computer readable medium encoded with software for automatically classifying a music piece, wherein the software is provided for:

determining a music type based on a detection of human singing by analyzing a waveform of the music piece comprising a composite of music components;

labeling the music piece as singing music when the music piece is determined to comprise human singing;

labeling the music piece as instrumental music when the music piece is not determined to comprise human singing; and classifying and labeling the music piece into a specific category of the determined music type, wherein the music piece labeled as singing music is classified based on at least one of frequency vibrations and spectral peak tracks in the music piece.

35. The method according to claim 34, wherein the presence of human singing on the music piece is determined by analyzing a spectrogram of the received music piece.

36. The method according to claim 34, including:

classifying the labeled singing music piece as either chorus music or solo music, based on spectral peak tracks in the singing music piece.

37. The method according to claim 36, wherein the singing music piece is classified as solo music if significant peaks of harmonic partials are found above the 2000–3000 Hz range in the singing music piece.

38. The method according to claim 34, wherein the labeled instrumental music piece is analyzed for occurrences of features indicative of symphonies, and wherein if at least one symphony feature is detected in the instrumental music piece, the instrumental music piece is labeled as symphony.

39. The method according to claim 38, wherein the symphony features include repetition, contrast, and variation of music signal or energy over time; sonata-allegro form; binary form; rondo form; regularities in movements; and alternating high and low volume intervals.

40. The method according to claim 34, wherein the labeled music piece is written into a library of classified music pieces.

41. The method according to claim 40, wherein the labeling and/or the writing of the labeled music piece is controlled by parameters selected by a user.

42. The method according to claim 41, wherein the labeled music piece is written into a hierarchical database according to a hierarchical structure of categories selected by the user and wherein the labeled music pieces in the hierarchical database can be browsed according to the hierarchy.

* * * * *